US007430954B2

(12) United States Patent
Miura et al.

(10) Patent No.: US 7,430,954 B2
(45) Date of Patent: Oct. 7, 2008

(54) WORK MACHINE

(75) Inventors: Keisuke Miura, Izumisano (JP); Atsushi Matsumoto, Osaka (JP); Masaaki Ueda, Sakai (JP)

(73) Assignee: Kubota Corporation, Osaka (JP)

( * ) Notice: Subject to any disclaimer, the term of this patent is extended or adjusted under 35 U.S.C. 154(b) by 220 days.

(21) Appl. No.: 11/375,545

(22) Filed: Mar. 14, 2006

(65) Prior Publication Data

US 2007/0068381 A1 Mar. 29, 2007

(30) Foreign Application Priority Data

Sep. 26, 2005 (JP) ..... 2005-278897
Sep. 26, 2005 (JP) ..... 2005-278898

(51) Int. Cl.
*F15B 13/044* (2006.01)

(52) U.S. Cl. ..... 91/459; 91/461

(58) Field of Classification Search ..... 91/459, 91/461, 463, 466

See application file for complete search history.

(56) References Cited

U.S. PATENT DOCUMENTS 5,138,838 A * 8/1992 Crosser ..... 91/461
5,784,945 A * 7/1998 Krone et al. ..... 91/459
6,078,855 A * 6/2000 Kinugawa et al. ..... 60/431
6,438,953 B1 * 8/2002 Kamada ..... 60/422
6,951,102 B2 * 10/2005 Tabor ..... 91/459

FOREIGN PATENT DOCUMENTS

JP 2002-39373 2/2002

* cited by examiner

*Primary Examiner*—Michael Leslie
(74) *Attorney, Agent, or Firm*—The Webb Law Firm

(57) ABSTRACT

A work machine includes an attachment movable by an actuator, an operational member for operating the attachment through the actuator; and a controller operable to output an operation signal for operating the actuator in response to an operation of the operational member. The controller allows setting of a change amount in the operation signal corresponding to an operational amount of the operational member, independently for each operational direction of the actuator.

6 Claims, 17 Drawing Sheets

Fig.5

| mode | explanation |
|---|---|
| effective mode | allow actuator to be operated according to operational amount of volume switch (operational member) |
| non-effective mode | inhibit actuator from being operated even when volume switch (operational member) is operated |
| operation mode | vary operation mode of actuator |
| ① bidirectional operation mode | allow bidirectional operation of actuator |
| ・bidirectional full open mode | set operation speed and response speed of actuator to maximum for operational amount in bidirectional operation of actuator |
| ・bidirectional speed limited mode | set operation speed and response speed of actuator to set level for operational amount in bidirectional operation of actuator |
| ② unidirectional operation mode | allow actuator to be operated in one direction only |
| ・unidirectional speed limited mode | set operation speed and response speed of actuator to set level for operational amount in unidirectional operation of actuator |
| setting mode | set in multiple steps operation speed and response speed of actuator according to operational amount of volume switch (operational member) |

Fig.6
(a)
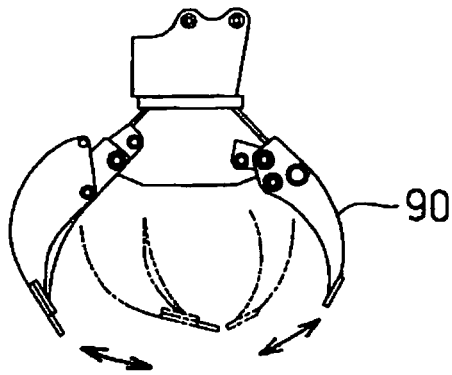
(b)
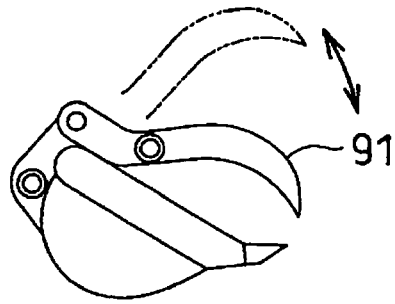
(c)
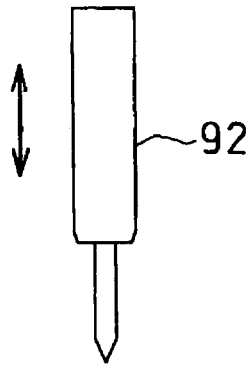
(d)
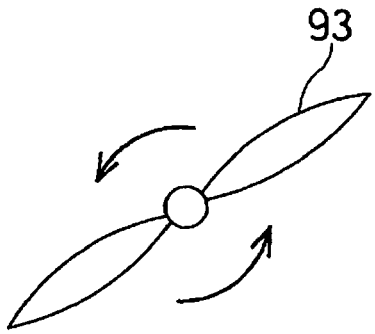

Fig.7
(a)
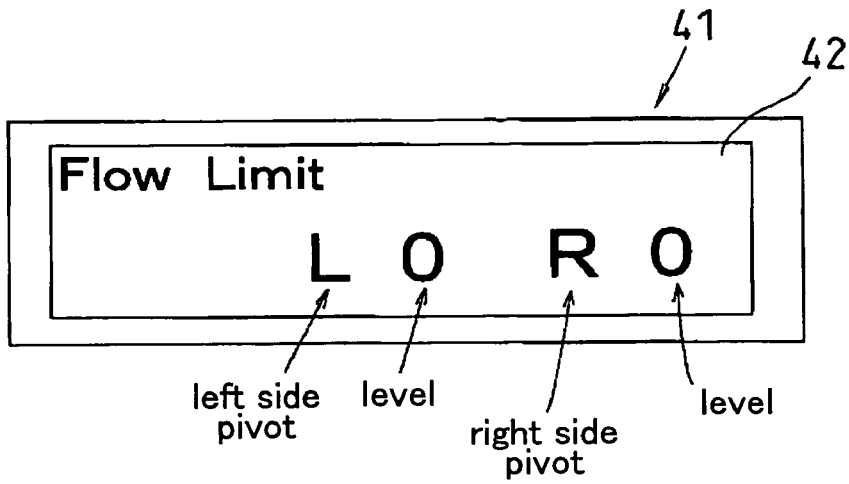
(b)
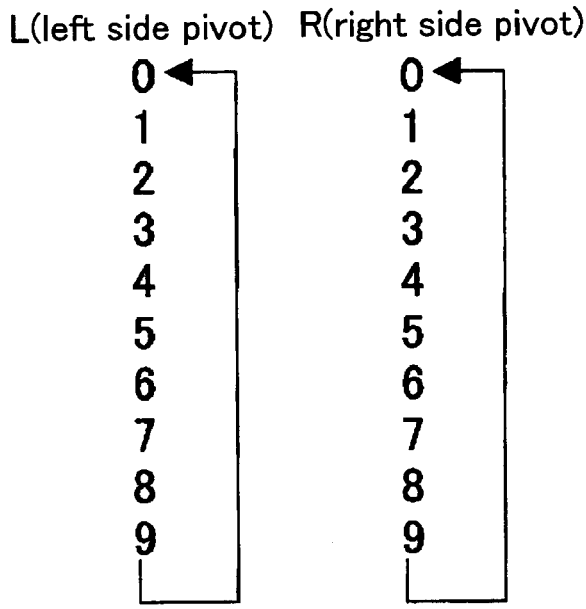
(c)
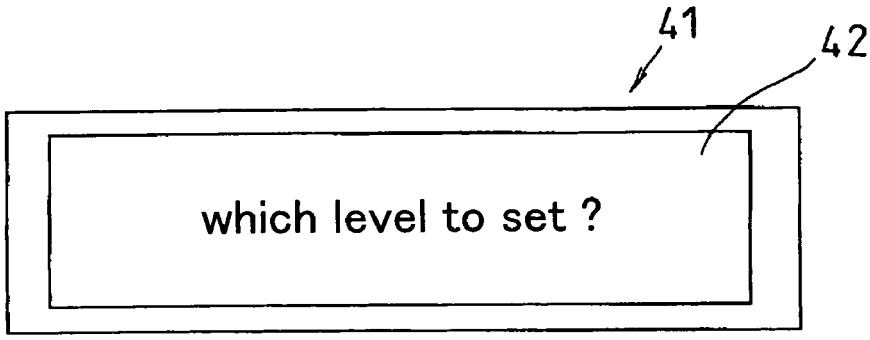

Fig.16
(a)
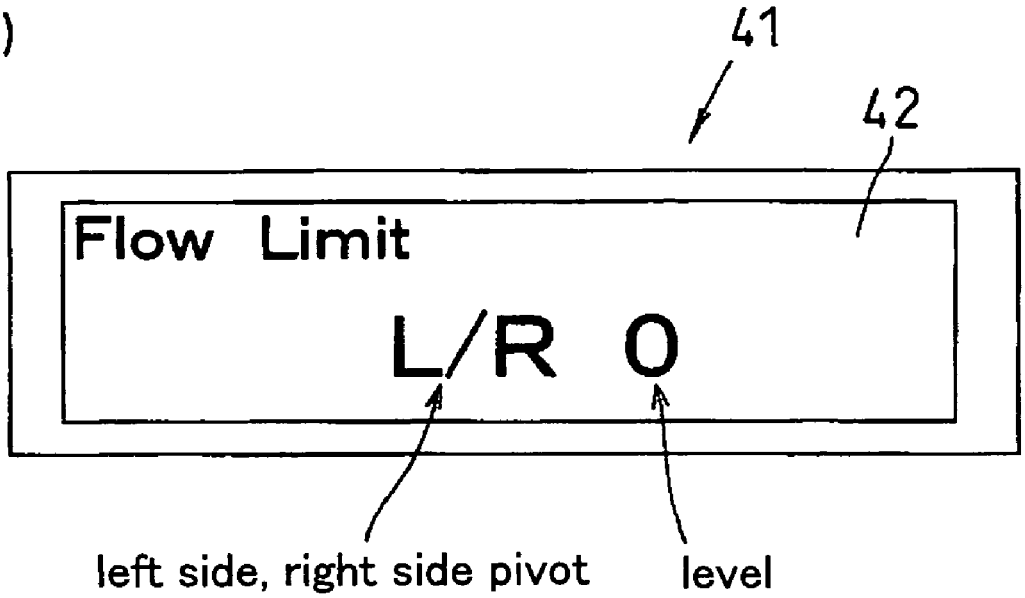
(b)
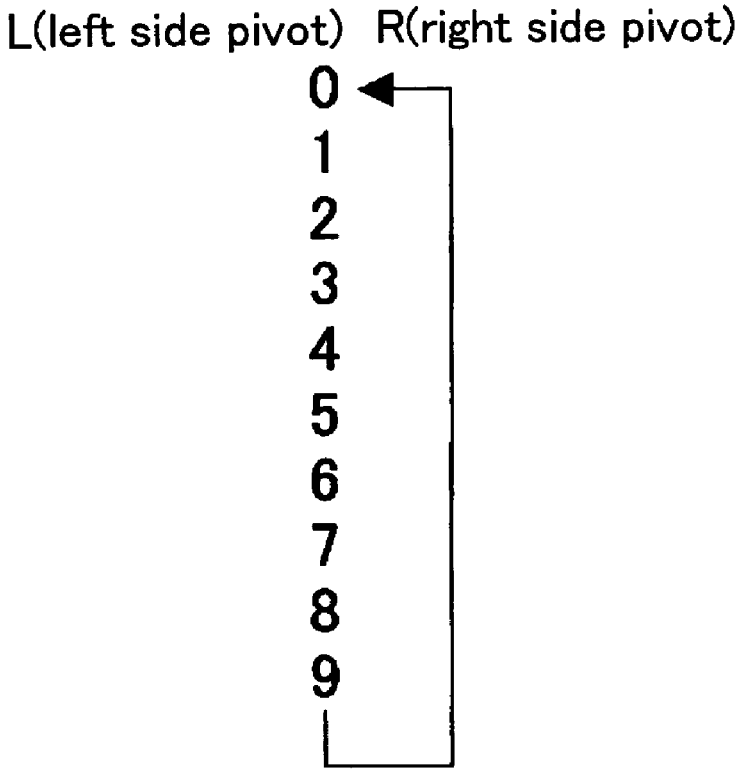

WORK MACHINE

FIELD OF THE INVENTION

The present invention relates to a work machine such as a backhoe.

BACKGROUND ART

There is known a backhoe including an implement to which a variety of attachments such as a breaker, a grapple, etc. can be selectively attached (see e.g. Japanese Patent Application "Kokai" No. 2002-39373). The attachment can be moved in association with an operation of an actuator such as a hydraulic cylinder by means of an operational member provided at an operator's section. The operational member can be operated when the engine of the backhoe is being driven. Hence, if the operational member is operated under such condition, the actuator is activated to move the attachment.

DISCLOSURE OF THE INVENTION

However, with the conventional work machine noted above, for one operational amount of the operational member, one fixed pilot pressure is provided to a control valve. Hence, the speed of movement or response speed of the actuator relative to the operational mount of the operational member is always the same. The movement speed and the response speed of the actuator also remain the same, regardless of the direction of the movement of the actuator.

As the movement speed and response speed of the actuator relative to the operational amount of the operational member are fixed as described above, when an attachment such as a breaker, a grapple, with different modes of movement is to be operated by the operational member, the operator needs to effect manual "sensory" adjustment of the operational amount of the operational member. Further, with such fixed movement speed and response speed of the actuator, it is not possible to appropriately set an operation mode of the attachment for each desired direction of movement of the attachment. For these reasons, the operation of the attachment can be very difficult.

Moreover, when the engine is running, the attachment is moved if the operational member is operated. Hence, when the operational member is not to be operated, the operator should be careful so as not to operate or move the operational member inadvertently.

In view of the above-described situations, the object of the invention is to provide a work machine with facilitated operation of the operational member, i.e. facilitated operation of the attachment.

SUMMARY OF THE INVENTION

For accomplishing the above-noted object, according to a first characterizing feature of the present invention, a work machine comprises:

an attachment movable by an actuator;

an operational member for operating the attachment through the actuator; and a controller operable to output an operation signal for operating the actuator in response to an operation of the operational member;

wherein the controller allows setting of a change amount in the operation signal corresponding to an operational amount of the operational member, independently for each operational direction of the actuator.

With the above-described construction, the change amount in the operation signal corresponding to the operational amount of the operational member can be set independently for each operational direction of the actuator. Hence, for each operational direction of the actuator, the change amount in the operation signal corresponding to the operational amount of the operational member can be set appropriately. As a result, the operational characteristics of the attachment corresponding to the operational amount of the operational member can be set appropriately, for each operational movement of the attachment. Hence, the operability of the attachment can be improved.

According to a second characterizing feature of the present invention, said controller allows the change amount in the operation signal corresponding to the operational amount of the operational member to be set in multiple steps.

With the above construction, the change amount in the operation signal corresponding to the operational amount of the operational member can be set in multiple steps. As a result, according to the type of attachment chosen, the operational characteristics corresponding to the operational amount of the operational member can be set appropriately. Hence, the operability of the attachment can be further improved.

According to a third characterizing feature of the present invention, said actuator is operable by working oil;

said work machine further comprises a control valve for feeding the working oil to the actuator and a plurality of electromagnetic valve connected to said control valve and provided in correspondence with a plurality of operational directions of said actuator;

said each electromagnetic valve is operable in response to said operation signal to adjust a pilot pressure for said control valve, thus adjusting an opening degree of said control valve; and said controller allows the setting of the change amount in the operation signal corresponding to the operational amount of the operational member, independently for each of the plurality of electromagnetic valves.

With the above construction, for the actuator operable by the working oil, the change amount in the operation signal corresponding to the operational amount of the operational member can be set independently for each operational direction of the actuator.

According to a fourth characterizing feature of the present invention, said electromagnetic valves comprise two electromagnetic valves connected to said control valve so that said actuator is movable in two directions opposite to each other.

With this construction, for each of one direction and the other opposite direction, the change amount in the operation signal corresponding to the operational amount of the operational member can be set appropriately.

According to a fifth characterizing feature of the present invention, said controller includes an effective mode for allowing said actuator to be operated according to an operation of the operational member and a non-effective mode for inhibiting said actuator from being operated in response to the operation of the operational member.

With the above construction, as the controller provides the effective mode for allowing the actuator to be operated according to an operation of the operational member and the non-effective mode for inhibiting the actuator from being operated in response to the operation of the operational member, it is possible to avoid inadvertent movement of the attachment when various kinds of attachment are operated.

According to a sixth characterizing feature of the present invention, said effective mode of the controller includes a plurality of operation modes for providing various operation modes of the actuator.

With the above construction, as the controller provides the plurality of operation modes, the operation mode of the actuator can be appropriately selected in accordance with the attachment of each kind chosen. As a result, the operability of the attachment can be further improved.

Further and other features and advantages of the present invention will become apparent upon reading the following detailed disclosure of preferred embodiments thereof with reference to the accompanying drawings.

BRIEF DESCRIPTION OF THE DRAWINGS

FIG. 5 is a chart describing various modes, FIG. 6 is a schematic of various kinds of attachments, FIG. 7 is an explanatory view explaining level setting, FIG. 16 is an explanatory view explaining a level setting in the modification.

DESCRIPTION OF PREFERRED EMBODIMENTS

Preferred embodiments of the present invention will now be described in details with reference to the accompanying figures. FIGS. 1-19 show a working machine relating to the present invention, showing a backhoe as an example thereof.

Figure 17:
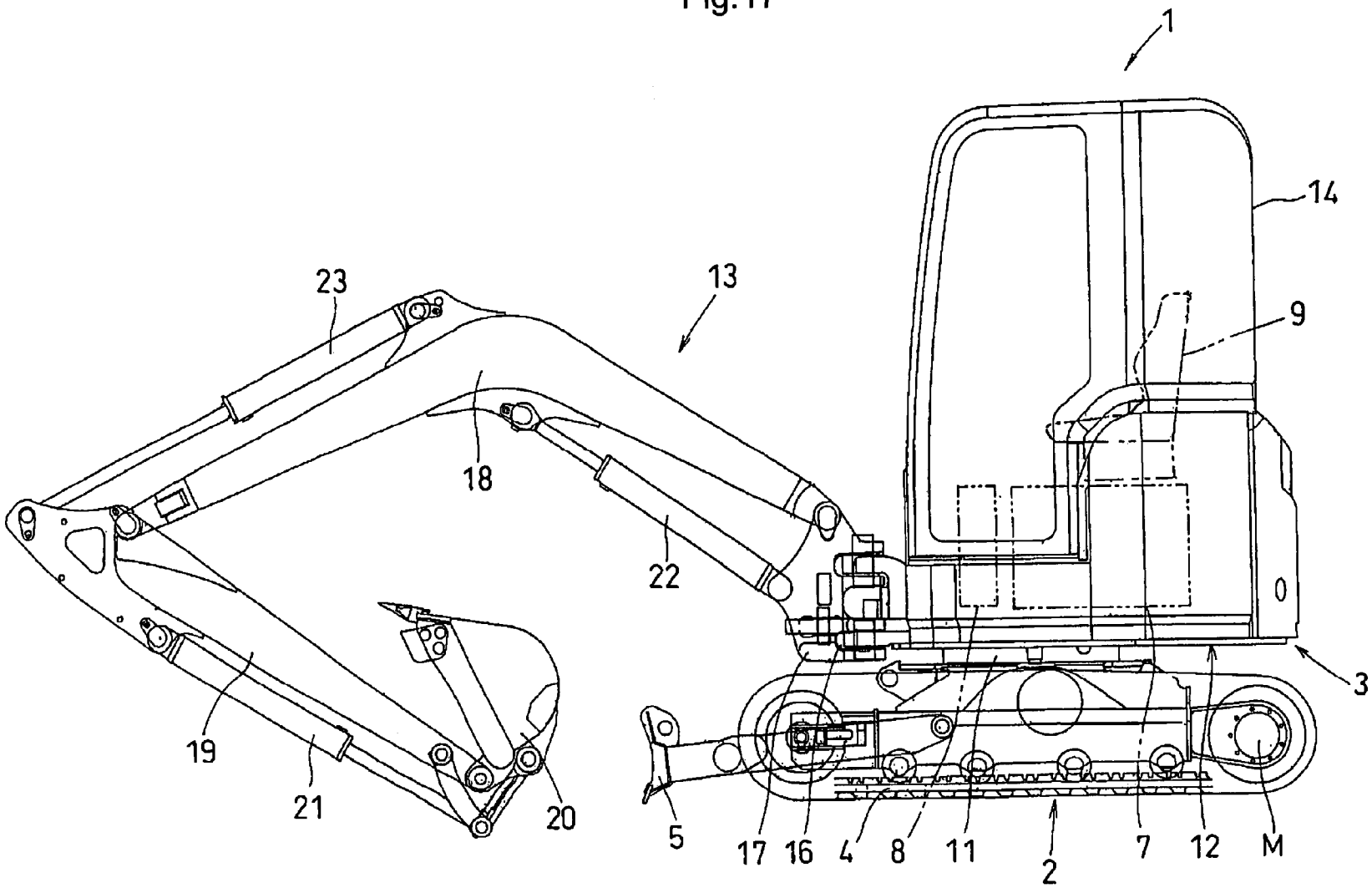
FIG. 17 is an overall view showing an entire side face of a backhoe.

As shown in FIG. 17, the working machine (backhoe) 1 includes a lower traveling apparatus 2 and an upper swiveling unit 3. The traveling apparatus 2 is constructed as a crawler type traveling apparatus including a pair of right and left traveling units 4 each having a crawler belt made of rubber and a motor M for driving the traveling units 4. Further, at the front portion of the traveling apparatus, a dozer 5 is mounted.

The swiveling unit 3 includes a swivel deck 12 mounted on the traveling apparatus 2 via a swivel bearing 11 to be swiveled to the right or left about a vertical swivel axis and an implement 13 (an excavator) mounted at a front portion of the swivel deck 2. The swivel deck 2 further mounts thereon an engine 7, a radiator 8, a driver's seat 9, a fuel tank, a working oil tank, etc. Further, on this swivel deck 12, there is disposed a cabin 14 surrounding the driver's seat 9. The engine 7 is arranged on the right side and covered with an opening/closing hood 15 or the like.

The engine 7 can be started with an operation of a key switch to a start position after switchover of the unillustrated ignition switch (key switch) from OFF position to ON position by an engine start key.

Referring to the implement 13, a swing bracket 17 is supported to a support bracket 16 to be pivotable to the right/left about a vertical axis, the support bracket 16 being disposed at a front portion of the swivel deck 12 with small offset to the right side from the right/left center. A boom 18 has a base portion thereof pivotally attached to the swing bracket 17 to be vertically pivotable about an axis extending along the right/left direction,. An arm 19 is pivotally supported to a leading end portion of the boom 18 to be pivotable about an axis extending along the right/left direction. And, a bucket 20 is attached to the leading end of the arm 19 to be capable of a rollback operation and a dumping operation.

The swing bracket 17 is pivoted in association with an extension/contraction of a swing cylinder disposed inside the swivel deck 12. The boom 18 is pivoted in association with an extension/contraction of a boom cylinder 22 interposed between this boom 18 and the swing bracket 17. The arm 19 is pivoted in association with an extension/contraction of an arm cylinder 23 interposed between this arm 19 and the boom 18. The bucket 20 is pivoted to effect a rollback operation or a dumping operation in association with an extension/contraction of a bucket cylinder 21 interposed between this bucket 20 and the arm 19.

To the leading end of the arm 19, instead of the bucket 20, various other attachments such as a grapple 90, a thumb 91, breaker 92, a brush cutter 93, a tilt bucket, etc. can be attached. Further, the leading end of the arm 19 incorporates a working oil feeding unit (not shown) for feeding working oil to such other attachment attached instead of the bucket 20.

The actuators respectively for the swing cylinder, the boom cylinder 22, the arm cylinder 23, the bucket cylinder 21, etc. are operable by the working oil. More particularly, the working oil stored inside the working oil tank mounted on the swivel deck 12 of the work machine is fed by a hydraulic pump 29 to a plurality of control valves 24 (24*a*, 24*b*, 24*c*, 24*d*, 24*e*) to be fed therethrough to the respective actuators for operating these respective actuators.

Figure 18:
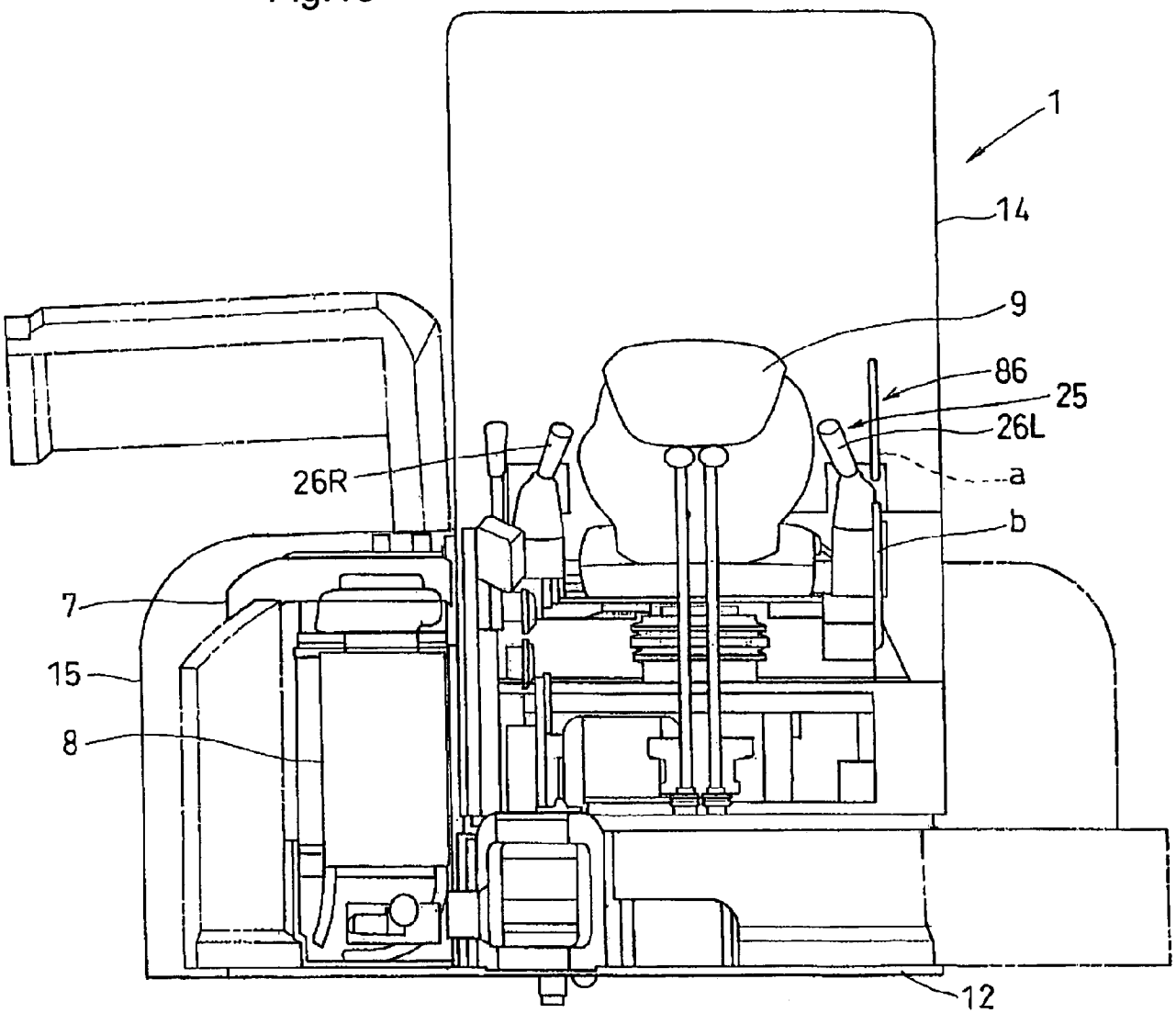
FIG. 18 is a front view showing a front face of the backhoe.
Figure 19:
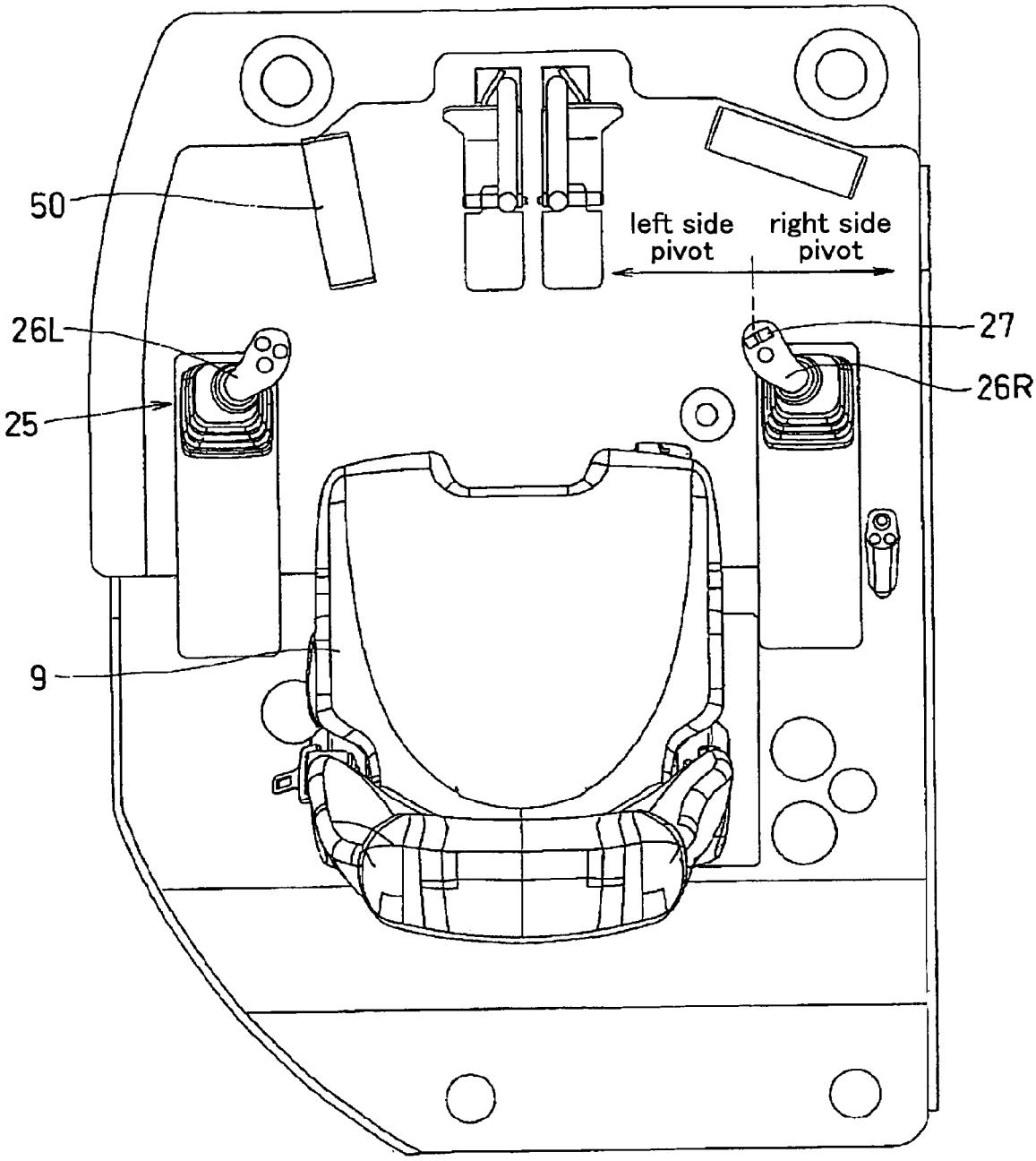
FIG. 19 is shows a layout of operational members adjacent a driver's seat.

As shown in FIGS. 18 and 19, each attachment is operated by an operational member 25 provided at the driver's seat 9. This operational member 25 includes a pair of left and right operational levers 26L, 26R provided on the left and right sides of the driver's seat 9, and a volume switch 27 (a near-hand operational portion) provided at a grip portion of one of the left and right operational levers 26L, 26R. For instance, the volume switch 27 is provided at the grip portion of the right operational lever 26R. Each of the left and right operational levers 26L, 26R is supported to be pivotable from a neutral position to the fore/rear side and right/left side. And, the volume switch 27 is supported to be pivotable on the grip portion from a neutral position to the right/left side.

Figure 1:
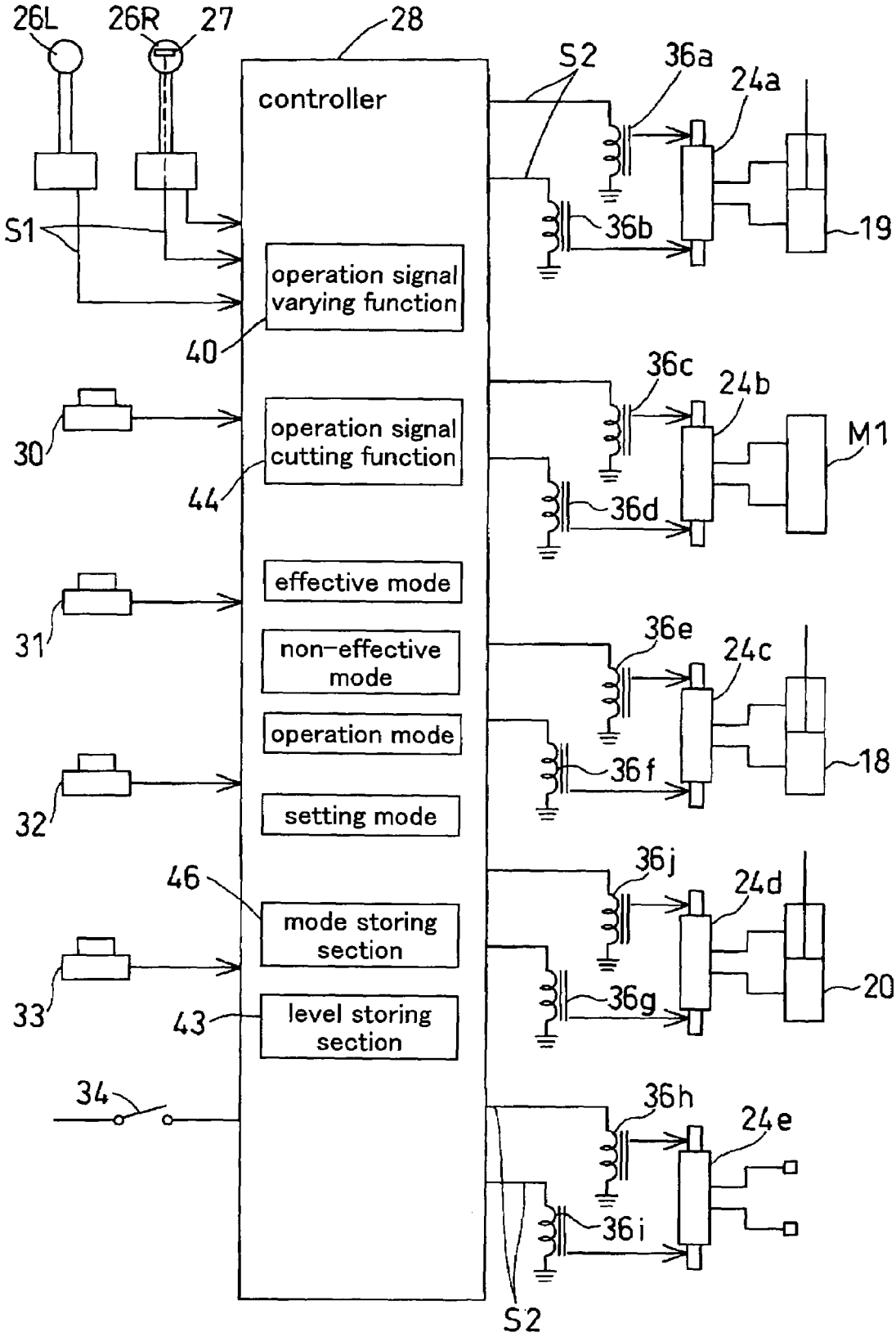
FIG. 1 is a schematic construction diagram of a system for operating actuators.

When each left or right operational lever 26L, 26R or the volume switch 27 is operated, its operational amount (operated angle) is detected by a position meter, a sensor or the like, and the operational amount is electrically converted into an operational signal to be outputted to a controller 28 (see FIG. 1).

Figure 2:
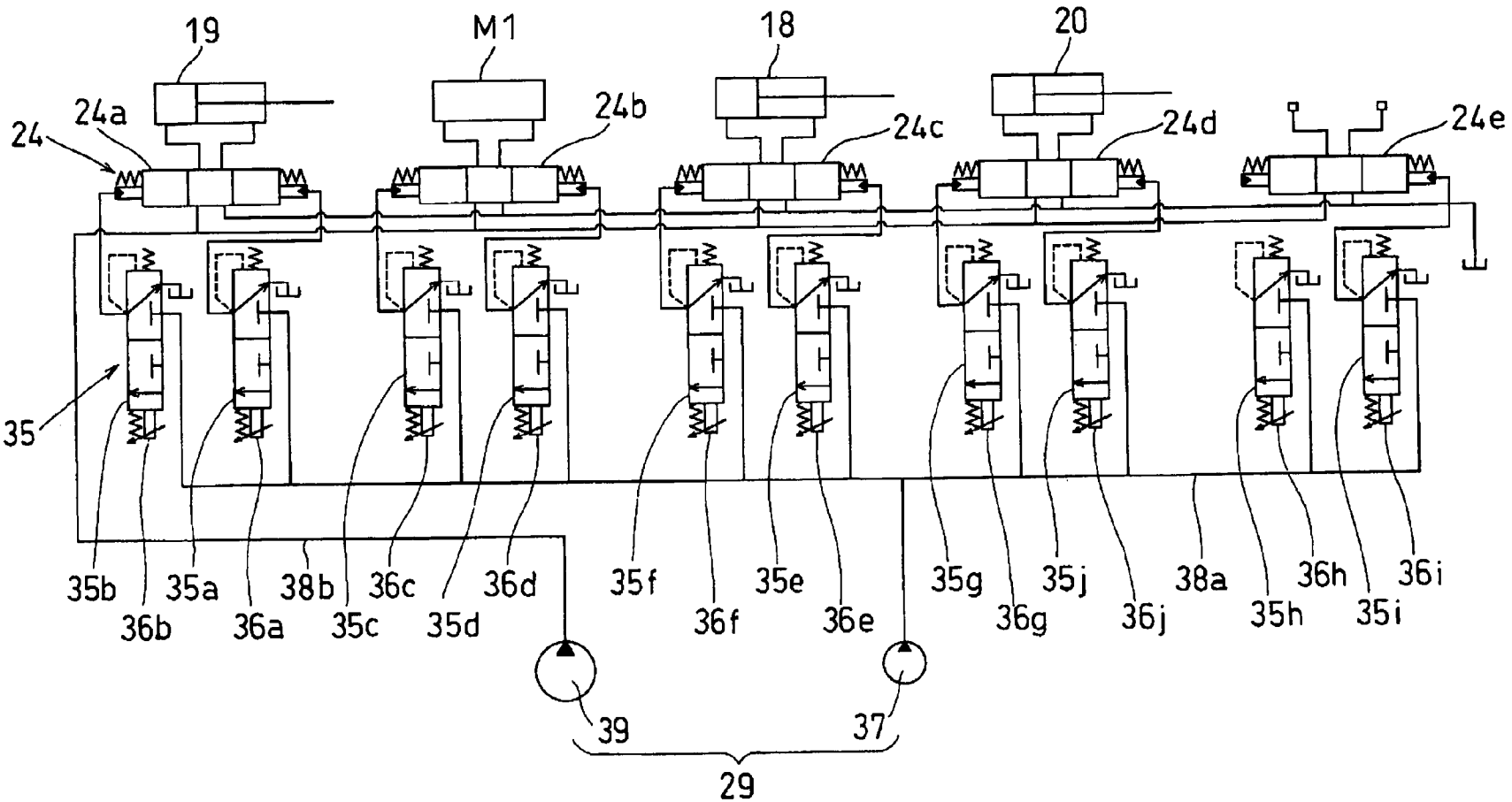
FIG. 2 is a circuit diagram of a hydraulic circuit for operating the actuators.

FIG. 1 is a schematic of a system for operating actuators, and FIG. 2 is a circuit diagram of a hydraulic circuit for operating the actuators.

The left and right operational levers 26L, 26R and the volume switch 27 are electrically connected to the controller 28 comprised of a CPU, etc. To this controller 28, there are connected an operation switch 30, a setting switch 31, a first selecting switch (left side selecting switch) 32, a second selecting switch (right side selecting switch) 33, and a key switch 34. To the controller 28, a plurality of electromagnetic valves 35 (35*a*, 35*b*, 35*c*, 35*d*, 35*e*, 35*f*, 35*g*, 35*h*, 35*i*, 35*j*) are also electrically connected.

When the controller 28 inputs an operational signal S1 corresponding to an operational amount (operational angle) of the left or right operational lever 26L, 26R or the volume switch 27, the controller 28 outputs an operation signal S2 corresponding to this operational signal S1 (operational amount) to each electromagnetic valve 35.

As shown in FIG. 2, each electromagnetic valve 35 is adapted to receive a pilot pressure from a first pump 37 via a first oil passage 38*a*, so that in association with an opening/closing of each electromagnetic valve 35, the pilot pressure to be applied to each control valve 24 is varied. Further, each control valve 24 is adapted to receive the working oil from a second pump 39 via a second oil passage 38*b*,so that the pilot pressure applied to each control valve 24 determines an opening degree of this control valve 24 and the working oil is fed to each actuator.

Next, basic operations of the respective actuators by operations of the operational member 25 will be described.

For instance, if the left operational lever 26L is pivoted to the fore side from the neutral position, the controller 28 outputs an electric current of a predetermined value, i.e. an operation signal S2, corresponding to the operational signal S1 (operated angle) of the left operational lever 26L to the fore side, to a solenoid 36*a* of the arm dumping electromagnetic valve 35*a*. Then, the arm dumping electromagnetic valve 35*a* is opened in accordance with the electric current value, that is, the operational signal S1 corresponding to the operational amount of the left operational lever 26L to the fore side, whereby the pilot pressure to the arm control valve 24*a* is controlled and the arm 19 effects a dumping operation at a speed proportional to the fore side operational amount of the left operational lever 26L.

If the left operational lever 26L is pivoted to the .rear side from the neutral position, the controller 28 outputs an electric current of a predetermined value corresponding to the operational signal S1 which is obtained by electrically converting the rear side operational amount of the left operational lever 26L, to a solenoid 36*b* of the arm raking electromagnetic valve 35*b*. Then, the arm raking electromagnetic valve 35*b* is opened according to the electric current value, whereby the pilot pressure to the arm control valve 24*a* is controlled and the arm 19 effects a raking operation at a speed proportional to the rear side operational amount of the left operational lever 26L.

When the left operational lever 26L. is pivoted to the left side from the neutral position, the controller 28 , outputs an electric current of a predetermined value corresponding to the operational signal S1 which is obtained by electrically converting the left side operational amount of the left operational lever 26L, to a solenoid 36*c* of the left swiveling electromagnetic valve 35*c*. Then, the left swiveling electromagnetic valve 35*c* is opened according to the electric current value, whereby the pilot pressure to the swivel control valve 24*b* is controlled and a swivel motor M1 is driven to swivel the swivel deck 12 to the left at a speed proportional to the left side operational amount of the left operational lever 26L.

When the. left operational lever 26L is pivoted to the right side from the neutral position, the controller 28 outputs an electric current of a predetermined value corresponding to the operational signal S1 which is obtained by electrically converting the right side operational amount of the left operational lever 26L, to a solenoid 36*d* of the right swiveling electromagnetic valve 35*d*. Then, the left swiveling electromagnetic valve 35*d* is opened according to the electric current value, whereby the pilot pressure to the swivel control valve 24*b* is controlled and the swivel motor M1 is driven to swivel the swivel deck 12 to the right at a speed proportional to the right side operational amount of the left operational lever 26L.

When the right operational lever 26R is pivoted to the fore side from the neutral position, the controller 28 outputs an electric current of a predetermined value corresponding to the operational signal S1 which is obtained by electrically converting the fore side operational amount of the right operational lever 26R, to a solenoid 36*e* of the boom lowering electromagnetic valve 35*e*. Then, the boom lowering electromagnetic valve 35*e* is opened according to the electric current value, whereby the pilot pressure to the boom control valve 24*c* is controlled and the boom 18 is lowered at a speed proportional to the fore side operational amount of the right operational lever 26R.

When the right operational lever 26R is pivoted to the rear side from the neutral position, the controller 28 outputs an electric current of a predetermined value corresponding to the operational signal S1 which is obtained by electrically converting the rear side operational amount of the right operational lever 26R, to a solenoid 36*f* of the boom elevating electromagnetic valve 35*f*. Then, the boom elevating electromagnetic valve 35*f* is opened according to the electric current value, whereby the pilot pressure to the boom control valve 24*c* is controlled and the boom 18 is elevated at a speed proportional to the rear side operational amount of the right operational lever 26R.

When the right operational lever 26R is pivoted to the left side from the neutral position, the controller 28 outputs an electric current of a predetermined value corresponding to the operational signal S1 which is obtained by electrically converting the left side operational amount of the right operational lever 26R, to a solenoid 36*g* of the bucket raking electromagnetic valve 35*g*. Then, the bucket raking electromagnetic valve 35*g* is opened according to the electric current value, whereby the pilot pressure to the bucket control valve 24*d* is controlled and the bucket 20 effects a raking operation at a speed proportional to the left side operational amount of the right operational lever 26R.

When the right operational lever 26R is pivoted to the right side from the neutral position, the controller 28 outputs an electric current of a predetermined value corresponding to the operational signal S1 which is obtained by electrically converting the right side operational amount of the right operational lever 26R, to a solenoid 36*j* of the bucket dumping electromagnetic valve 35*j*. Then, the bucket dumping electromagnetic valve 35*j* is opened according to the electric current value, whereby the pilot pressure to the bucket control valve 24*d* is controlled and the bucket 20 effects a dumping operation at a speed proportional to the right side operational amount of the right operational lever 26R.

When the volume switch 27 is pivoted to one side (left side) from the neutral position, the controller 28 outputs an electric current of a predetermined value corresponding to the operational signal S1 which is obtained by electrically converting the left side operational amount of the volume switch 27, to a solenoid 36*h* of the left SP electromagnetic valve 35*h*. Then, the left SP electromagnetic valve 35*h* is opened according to the electric current value, whereby the pilot pressure to the SP control valve 24*e* is controlled and an attachment attached to the leading end of the arm 19 can be moved to one direction. For instance, as shown in FIG. 6 (*a*), in the case of the grapple 90 attached to the leading end of the arm 19 to be capable of a grappling operation in association with a pivotal movement thereof to the right/left side, a grappling operation of this grapple 90 can be effected.

When the volume switch 27 is pivoted to the other side (right side) from the neutral position, the controller 28 outputs an electric current of a predetermined value corresponding to the operational signal S1 which is obtained by electrically converting the right side operational amount of the volume switch 27, to a solenoid 36*i* of the right SP electromagnetic valve 35*i*. Then, the right SP electromagnetic valve 35*i* is opened according to the electric current value, whereby the pilot pressure to the SP control valve 24*e* is controlled and an attachment attached to the leading end of the arm 19 can be moved to the other direction. For instance, in the case of the grapple 90 attached to the leading end of the arm 19, an opening operation of this grapple 90 can be effected.

Therefore, by opening/closing the two electromagnetic valves 35*h*, 35*i* connected to the SP control valve 24*e*, the attachment can be moved in the both directions.

Figure 3:
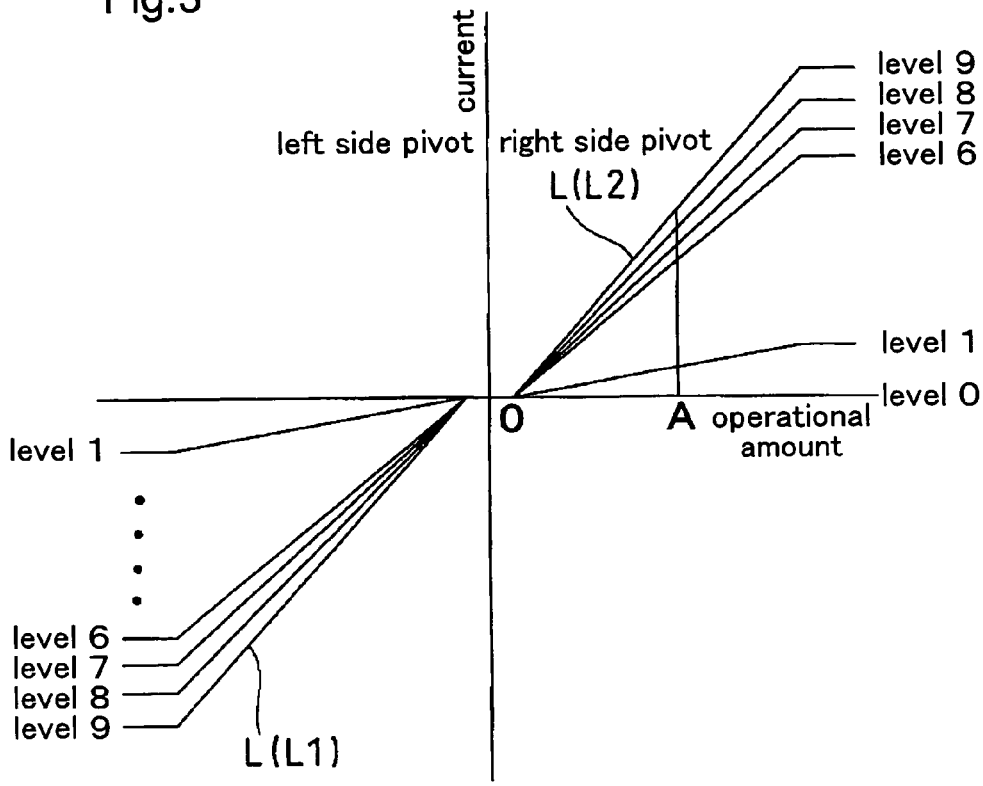
FIG. 3 is a control map diagram showing control of an electromagnetic valve.
Figure 4:
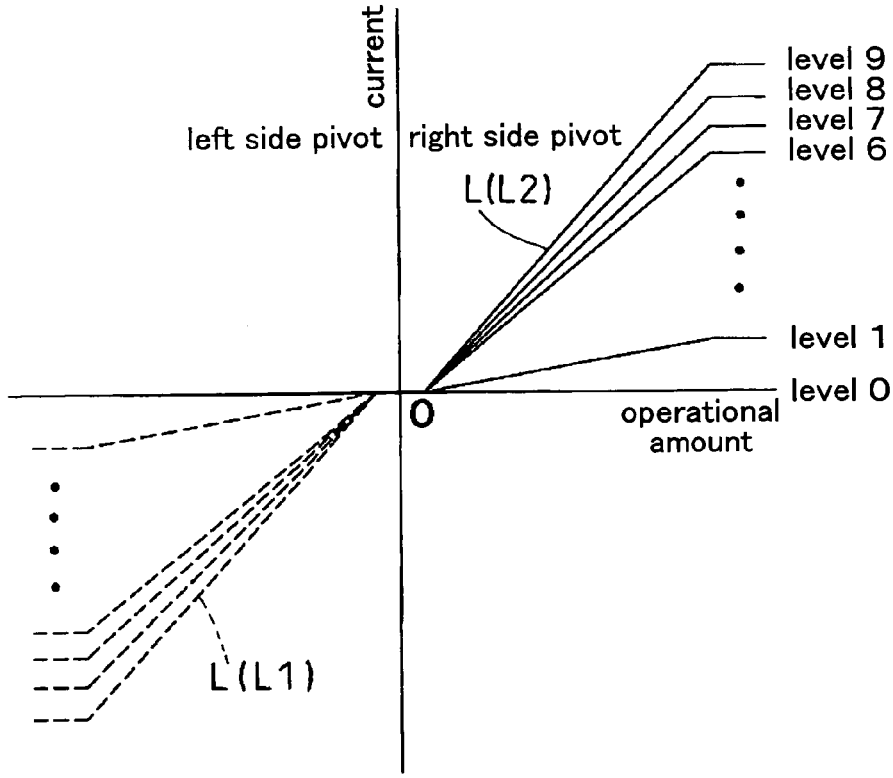
FIG. 4 is a control map diagram showing a control of the electromagnetic valve, with cutting conversion lines.

FIGS. 3 and 4, show control maps diagram showing control by the controller 28 when the volume switch 27 is pivotally operated to the right/left from the neutral position. In these FIGS. 3 and 4, the horizontal axis represents the operational amount (operational signal) of the volume switch 27 and the vertical axis represents the electric current value of the operation signal S2 to the outputted to the respective SP electromagnetic valves 35*h*, 35*i*. The control maps of the controller 28 include conversion lines L for converting each operational amount to an electric current value. Hence, based on these conversion lines L, the controller 28 converts an operational amount of the volume switch 27 to an electric current value substantially proportional to this operational amount and outputs this as an operation signal S2 to the respective SP electromagnetic valves 35*h*, 35*i*.

As shown in FIGS. 3 and 4, the conversion line L1 present on the left side of the origin O is used for the conversion of an operational amount into an electric current value when the volume switch 27 is operated to the left side (left side pivot). The conversion line L2 present on the right side of the origin O is used for the conversion of an operational amount into an electric current value when the volume switch 27 is operated to the right side (right side pivot).

Hence, the controller 28 includes the independent conversion lines L1, L2 independently for the left side pivot and the right side pivot of the volume switch 27. So that the operational amount for each of the left side pivot and the right side pivot of the volume switch 27 can be converted to an electric current value independently by either conversion line L1 or L2 corresponding to the direction of the pivot.

Now, suppose that the operational amount of the volume switch 27 when operated to the right side about the origin O is represented by the positive side and the operational amount thereof when operated to the left side about the origin O is represented by the negative side. Then, when the operational amount is on the positive size, a positive current will be outputted. Whereas when the operational amount is on the negative side, a negative current will be outputted.

Incidentally, FIG. 4 shows an example cutting one conversion line L1 of the conversion lines L1, L2. The dot lines of the conversion line L1 in FIG. 4 indicate the cutting of the conversion line L1 for the left side pivot. According to the control map of the controller 28, as will be described later, the control operation can be effected with cutting at least one of the conversion lines L1, L2 for the left or right side pivot by an operation signal cutting function 44.

According to the control of the control map, relative to a reference level (0 level), the greater the electric current value of the volume switch 27 when pivoted to the right, the greater the opening degree of the right SP electromagnetic valve 35*i*. Whereas, the smaller the electric current value of the volume switch 27 when pivoted to the left, the greater the opening degree of the left SP electromagnetic valve 35*h*. That is to say, in the controls of the SP electromagnetic valves 35*h*, 35*i* according to the control map, the closer the electric current value to the reference level, the smaller the opening degree of each SP electromagnetic valve 35*h*, 35*i*. The farther the electric current value from the reference level, the greater the opening degree of each SP electromagnetic valve 35*h*, 35*i*.

Incidentally, the controller 28 includes an operation signal varying function 40 for setting multiple stages of electric current values corresponding to the operational amount of the volume switch 27. In other words, for one operational amount determined by operation of the volume switch 27, the controller 28 includes a plurality of values for converting this operational amount to an electric current value. In the case of the control map disclosed in this embodiment, when the operational amount is at point A, there are provided 9 (nine) electric current values corresponding to that operational amount.

More particularly, for each of the left side pivot and the right side pivot, the control map of the controller 28 includes a plurality (e.g. nine) of conversion lines L for converting the operational amount for each single operational amount.

Each conversion line L has a different inclination at an intermediate portion thereof to provide a progressively larger or smaller electric current to be outputted as the operational amount increases. If the magnitude of the inclination at the intermediate portion of each conversion line L is considered as a level, there are a plurality of stages of level. The conversion line 1 corresponding to level 9 has the greatest inclination. The smaller the value of the level, the smaller the inclination of the conversion line L.

Taking the respective conversion lines L2 for the right side pivot of the volume switch 27 for example, when the operational amount is at point A in the control map, the conversion line L2 of level 9 provides the greatest electric current value. The smaller the level, the smaller the electric current value to be converted for the operational amount at point A. Incidentally, it is preferred that the inclinations of the respective conversion lines L relative to the reference level be rendered different by a fixed angle (e.g. 5 degrees each).

Next, regarding the operation of the actuator under the control according to the control map, there will be described, as an example, a case when the volume switch 27 is pivoted to the right side. Incidentally, when the control according to the control map is effected, one of the plurality of conversion lines L is selected as will be described later.

If the level 9 conversion line L is selected and the volume switch 27 is pivoted to the right side, the electric current value corresponding to the operational amount and its change amount (i.e. the inclination in terms of the conversion line L) are large, even with a small pivotal operation of the volume switch 27, the resultant electric current value and the change amount will be large. As a result, the opening degree of the right SP electromagnetic valve 35*i* will be increased and the opening speed of this right SP electromagnetic valve 35*i* too will be increased, thus increasing the operational speed of the attachment attached to the leading end of the arm 19 and also increasing the response speed (quicker response) in response to the volume switch 27 operation.

On the other hand, if the level 1 conversion line L is selected and the volume switch 27 is pivoted to the right side, the electric current value corresponding to the operational amount and its change amount will be small. Hence, even if the volume switch 27 is pivoted just like the case of the level 9, the electric current value and its change amount to be outputted in correspondence with this operational amount will be small. As a result, the opening degree of the right SP electromagnetic valve 35*i* will be decreased and the opening speed of the right SP electromagnetic valve 35*i* too will be decreased, thus decreasing the operational speed of the attachment attached to the leading end of the arm 19 and also decrease the response speed (slower response) in response to the volume switch 27 operation.

Therefore, if the control is effected with a high level conversion line L, the operation speed of the attachment can be increased and the response speed for the operational amount can be faster. Whereas, if the control is effected with a low level conversion line L, the operation speed of the attachment can be decreased and the response speed for the operational amount can be slower.

As shown in FIG. 5, the controller 28 includes a plurality of modes. More particularly, the controller 28 includes an effective mode for allowing the actuator to be operated according to an operational amount of the volume switch 27, a non-effective mode for inhibiting the actuator from being operated in response to an operation of the volume switch 27, an operation mode for varying the operation mode of the actuator and a setting mode for setting the speed change amount of the actuator in multiple steps in accordance with an operational amount of the volume switch 27.

Next, each mode will be described.

When the controller 28 is set to the effective mode, if the controller 28 receives an operational signal from the volume switch 27, the controller 28 outputs a current (operation signal S2) corresponding to the operational amount of the volume switch 27 to each SP electromagnetic valve 35*h*, 35*i*. When the controller 28 is set to the non-effective mode, even if the controller 28 receive an operational signal from the volume switch 27, the controller 28 does not output to each SP electromagnetic valve 35*h*, 35*i*, any current corresponding to the operational amount of the volume switch 27. Namely, in the non-effective mode, the controller 27 outputs no current to the respective SP electromagnetic valves 35*h*, 35*i*, thus inhibiting the associated actuators for SP from being operated.

When the controller 28 is set to the setting mode, with the operation signal varying function 40, it is possible to select the level of the conversion line L for right or left side pivot. Namely, from the nine conversion lines L2 corresponding to the right side pivot of the volume switch 27, one conversion line L can be selected. Also, from the nine conversion lines L1 corresponding to the left side pivot of the volume switch 27, one conversion line L can be selected.

As shown in FIG. 7 (*a*), when the controller 28 is set to the setting mode, a display device 40 displays at its display section 41, the levels of the conversion lines L for the left side pivot (L) and the right side pivot (R). And, as shown in FIG. 7 (*b*), with each depression on a left side selecting switch 32 or a left side selecting switch 33, the level of the depressed side will be incremented. When the level reaches the maximum (level 9), the level will then return to the minimum (level 0). Hence, the left side selecting switch 32 or the right side selecting switch 33 provides a loop of 0 to 9 level values.

Incidentally, the level 0 represents the horizontal axis of the control map. As the controller 28 does not employ any conversion line L when at level 0, the electric current value corresponding to the operational amount will always be 0 (zero).

And, after a level of the pivot side (left pivot or right pivot) is determined by the left side selecting switch 32 or the right side selecting switch 33 and then the setting switch 31 is depressed, the setting mode is ended. Then, this determined level is stored at a level storing section 43. When an operation is to be effected, the level stored at the level storing section 43 will be read out and this will be set as the level of the conversion line L.

Therefore, with the operational signal varying function 40 included in the controller 28, the level of the conversion line L can be varied. And, with such variation of the level of conversion line L, it is possible to vary in multiple steps, the electric current value (operation signal S2) corresponding to the operational amount of each SP electromagnetic valve 35*h*, 35*i*.

The operation mode includes a bidirectional operation mode and a unidirectional operation mode. When the controller 28 is set to the bidirectional operation mode, the controller 28 outputs an electric current to each SP electromagnetic valve 35*h*, 35*i* in accordance with both the left side and right side pivots of the volume switch 27. Whereas, when the controller 28 is set to the unidirectional operation mode, even if the volume switch 27 is pivoted to both the left side and the right side, the controller 28 does not output the electric current to both the SP electromagnetic valves 35*h*, 35*i*, but outputs the current only to one SP electromagnetic valve instead. More particularly, as shown in FIG. 4, when the controller 28 is set to the unidirectional operation mode, when effecting the control based on the control map, the controller 28 cuts the other left or right side conversion lines L, so that no operation signal S2 will be outputted to the other electromagnetic valve. This is the operation signal cutting function 44 included in the controller 28. As this operation signal cutting function 44 inhibits operation of one of the two SP electromagnetic valves, it is possible to move the actuator in one direction alone.

The bidirectional operation mode includes a bidirectional full open mode and a bidirectional speed limited mode. When the controller 28 is set to the bidirectional full open mode, even if certain levels of the conversion lines L have been set for the respective right and left pivots, the levels of the conversion lines L for the respective right and left pivots will be set automatically to the maximum. For instance, suppose the conversion line L1 for the left side pivot has been set to level 7 and the conversion line L2 for the right side pivot has been set to level 3, respectively. Even so, under the operation in the bidirectional full open mode, the levels of the conversion lines L1, L2 will be fixed respectively to the maximum of level 9, and based on these level 9 conversion lines L1, L2, the respective SP electromagnetic valves 35*h*, 35*i* will be controlled.

Whereas, when the controller 28 is set to the bidirectional speed limited mode, the operational amounts of the respective right and left pivots will be converted into respective electric current values based on the respective levels of the conversion lines L1, L2 which have been set at the setting mode. For example, in case the left side pivot conversion line L1 has been set to level 7 and the right side pivot conversion line L2 has been set to level 3, respectively, if the controller 28 is set to the bidirectional speed limited mode, the conversion line L1 will be set to level 7 and the conversion line L2 will be set to level 3, and using the conversion lines L1, L2 of these set levels, the respective SP electromagnetic valves 35*h*, 35*i* will be controlled.

The unidirectional operation modes include a unidirectional speed limited mode. When the controller 28 is set to this unidirectional speed limited mode, as shown in FIG. 4, one conversion line L of either the left side pivot or the right side pivot of the volume switch 27 is cut, so that the electric current is outputted to either one SP electromagnetic valve of the two SP electromagnetic valves. That is, when effecting the control according to the control map, the controller 28 covers the operational amount into an electric current value with using the conversion line (uncut conversion line L) corresponding to the level set under the setting mode, and this signal will be outputted to either one SP electromagnetic valve only.

For instance, in case the conversion line L1 for the left side pivot is set to level 7 and the conversion line L2 for the right side pivot is set to level 3, if the controller is set to the unidirectional speed limited mode, either one of the level 7 conversion line L1 or the level 3 conversion line L2 will be cut, and only one control will be effected.

Next, setting of the respective modes will be described.

The effective mode and non-effective mode can be switched over by means of the operation switch 30 or the key switch 34 electrically connected to the controller 28. More particularly, under a non-operating condition of the power source for operating the actuator (e.g. under the stop condition of the engine 7), the ignition switch (key switch 34) of the engine 7 will be switched from ON to OFF and with this OFF of the key switch 34, the controller 28 enters the non-effective mode.

When the controller 28 enters the non-effective mode with switching of the key switch 34 from ON to OFF, the controller 28 stores the operation mode prior to the OFF of the key switch 34 at a mode storing section 46. In other words, if the unidirectional operation mode was selected prior to the OFF of the key switch 34, the controller 28 will determine that the operation of the volume switch 27 is now complete and then store at the mode storing section 46 the selected operation mode, in this case, the termination of the work under the unidirectional operation mode.

Then, if the key switch 34 is switched from OFF to ON, the power of the battery will be supplied to the various components of the work machine, so that the engine 7, the hydraulic pump 29, etc. for operating the actuators become ready for operation. Under this condition, if the operation switch 30 is depressed, the controller 28 will be switched over from the non-effective mode to the effective mode. That is, the change of the condition of the key switch 34 from OFF to ON alone is not sufficient to switch over the controller 28 from the non-effective mode to the effective mode. If under this operable condition the operation switch 30 is depressed, then, the controller 28 will be changed (switched over) from the non-effective mode to the effective mode eventually.

As may be understood from the above, this backhoe includes a mode confirming means for allowing switchover from the non-effective mode to the effective mode when the controller 28 is set to the non-effective mode. This mode confirming means comprises a program incorporated in the controller 28, the operation switch 30, etc.

When the mode confirming means allows the controller 28 to be switched over from the non-effective mode to the effective mode, the controller 28 will be set to the particular operation mode stored at the mode storing section 46. Namely, when the controller 28 is switched to the effective mode, the controller 28 reads out the mode stored at the mode storing section 46 and will be automatically set to the read mode. For instance, as described above, suppose the unidirectional operation mode was present at the time of the ON to OFF change of the key switch 34, and this mode has been stored at the mode storing section 46. Then, when the non-effective mode is switched over to the effective mode with OFF to ON change of the key switch 34, the operation mode of the controller 28 will be automatically set to the one directional operation mode.

Figure 8:
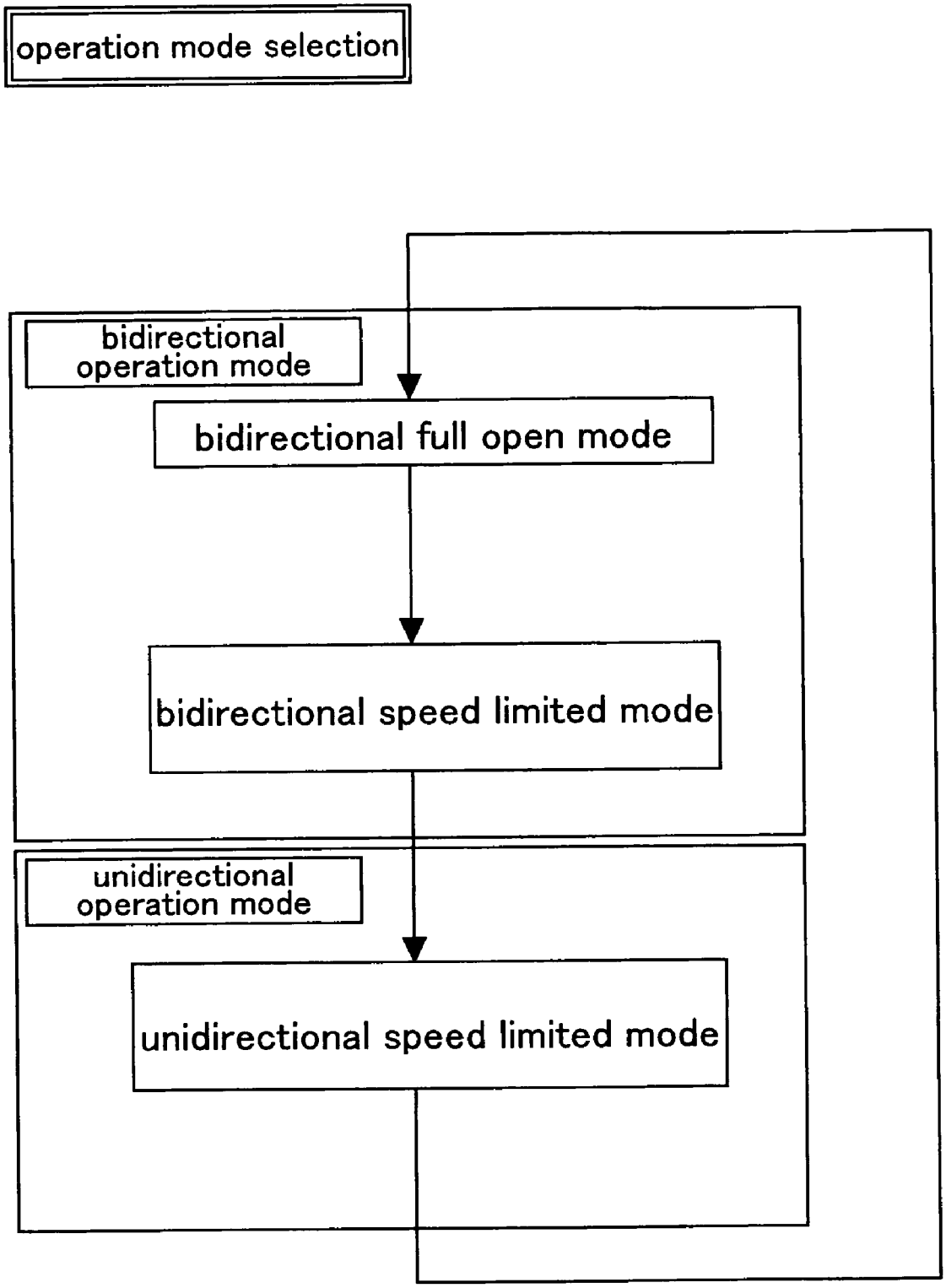
FIG. 8 is an explanatory view explaining operation mode selection.

If the key switch 34 is changed from OFF to ON and the operation switch 30 is depressed, the non-effective mode is switched over to the effective mode as described above. Under this condition, if the operation switch 30 is depressed, then, the controller will enter an operation mode selecting condition. More particularly, as shown in FIG. 8, after the operation mode is switched over to the effective mode, with each depression of the operation switch 30, the mode will be switched over to the bidirectional full open mode, the bidirectional speed limited mode, and then to the unidirectional speed limited mode in the mentioned order. Then, under the unidirectional speed limited mode, if the operation switch 30 is depressed, the mode is switched over, i.e. returned to the bidirectional full open mode in a loop manner.

Next, with reference to the flowcharts of FIGS. 9-15, the respective modes will be described in details.

Figure 9:
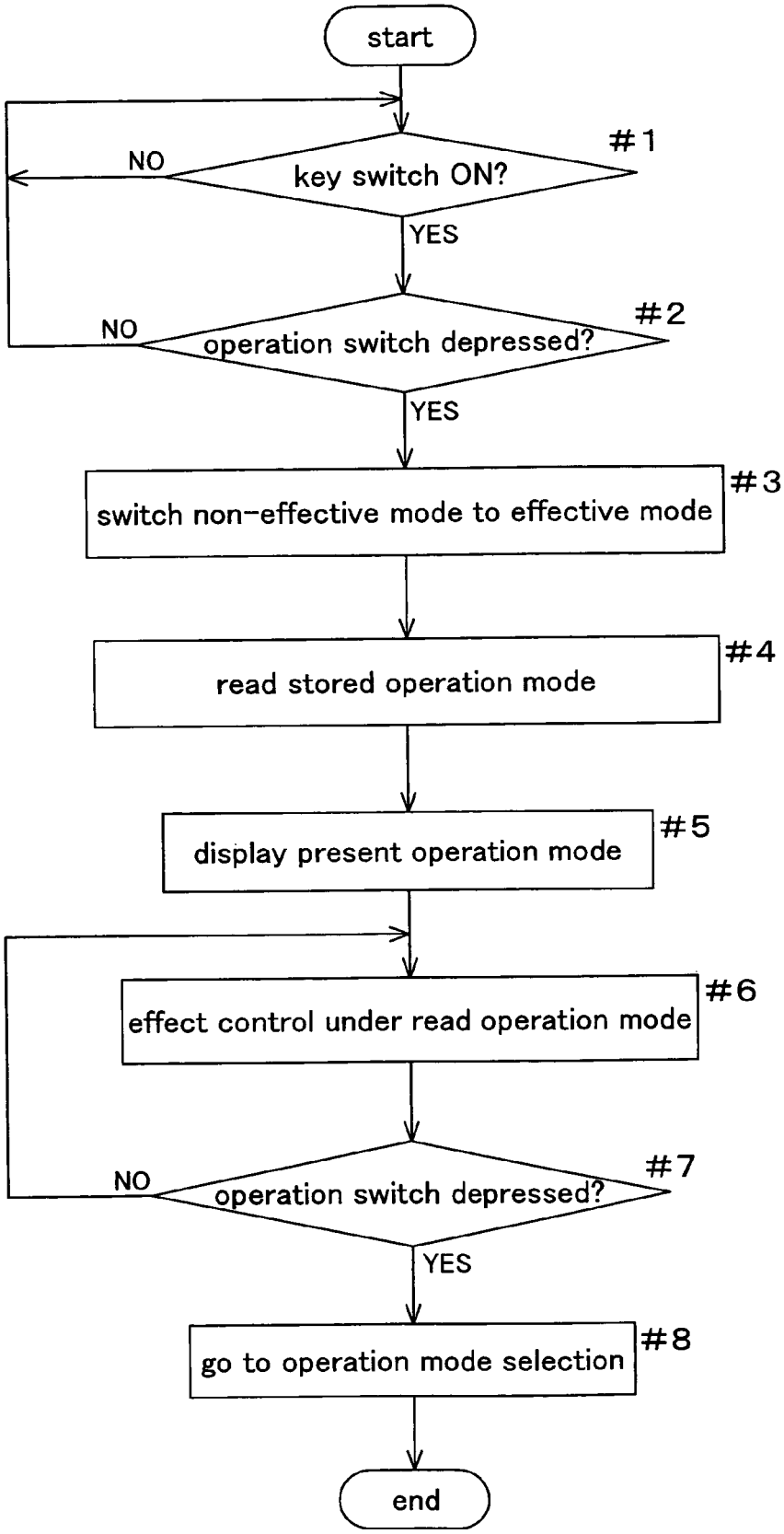
FIG. 9 is a flowchart illustrating an operation of switching a non-effective mode to an effective mode.

FIG. 9 shows a flowchart of the switchover from the non-effective mode to the effective mode. When the engine 7 is stopped, the controller 28 is set under the non-effective mode, so that even if the volume switch 27 is pivoted, the controller 28 will not output any current to the SP electromagnetic valves 35*h*, 35*i* and the control valves 24 and the actuators will not be activated.

At step #1, the process determines whether the key switch 34 has been switched ON or not. More particularly, when the key switch 34 is OFF, the controller 28 comprised of the CPU etc is inoperable for effecting any control. When the key switch 34 is ON, if the controller 28 receives a signal indicative of the ON of the key switch 34, the controller 23 becomes operable to effect control.

At step #2, the process determines whether the operation switch 30 has been depressed under the ON condition of the key switch 34 or not. If the operation switch 30 has been depressed, then, the process goes to step #3. Whereas, if the operation switch 30 has not been depressed, then the mode of the controller 28 is maintained under the non-effective mode, so that even if the volume switch 27 is operated, no current will be outputted to the respective SP electromagnetic valves 35*h*, 35*i*.

At step #3, the mode of the controller 28 is switched over from the non-effective mode to the effective mode by the mode confirming means. With this, the actuator becomes ready to be activated with an operation of the volume switch 27. At step #4, the controller 28 reads out the mode stored at the mode storing section 46 and will automatically be set to the mode read out. At step #5, the read mode is displayed at the displaying section 42 of the display device 41. With this, the operator can confirm the presently set mode.

At step #6, the controller 28 effects control under the read operation mode. That is, the controller 28 outputs currents to the SP electromagnetic valves 35*h*, 35*i* corresponding to the operational amount of the volume switch 27. At step #7, the process determines' whether the operation switch 30 has been depressed or not. If the operation switch 30 has been depressed, the process goes to step #8 and shifts to the operation mode selection illustrated in FIG. 8, thus allowing selection of the operation mode.

Figure 10:
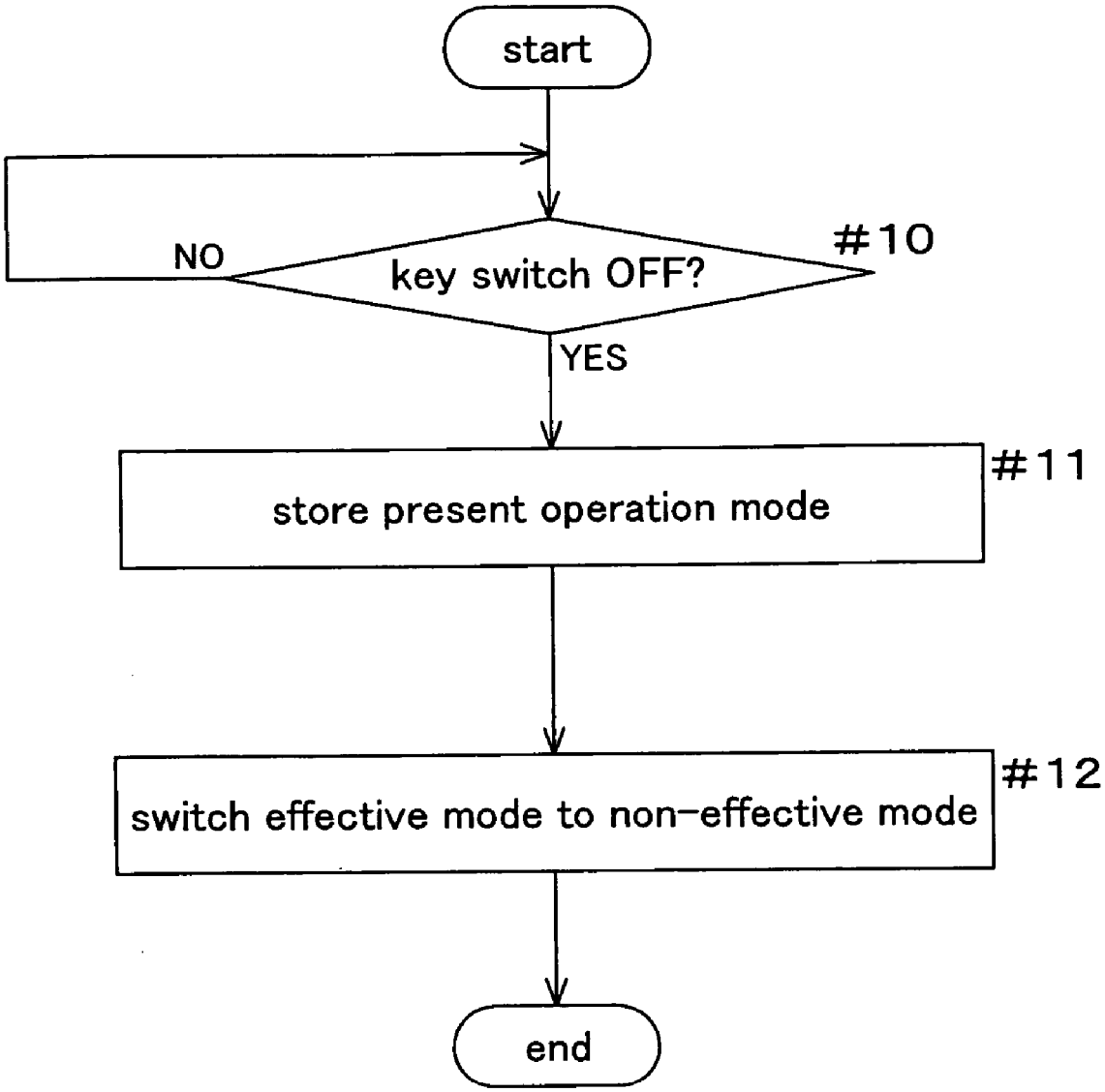
FIG. 10 is a flow chart illustration an operation of switching the effective mode to the non-effective mode.

FIG. 10 shows a flow chart of the switchover from the effective mode to the non-effective mode.

At step #10, the controller 28 determines whether the key switch 34 has been switched OFF or not. At step #11, if the controller 28 inputs an OFF signal of the key switch 34, the controller 28 stores the present operation mode at the mode storing section 46. At step #12, the controller 28 switches from the effective mode to the non-effective mode.

Therefore, when the key switch 34 has been switched OFF by the engine start key for starting the engine 7, thus stopping the engine 7, the controller 28 is switched to the non-effective mode.

Incidentally, another switch can be provided for enabling the non-effective mode under the effective mode, such that with depression of this further switch, the effective mode may be switched over to the non-effective mode.

Figure 11:
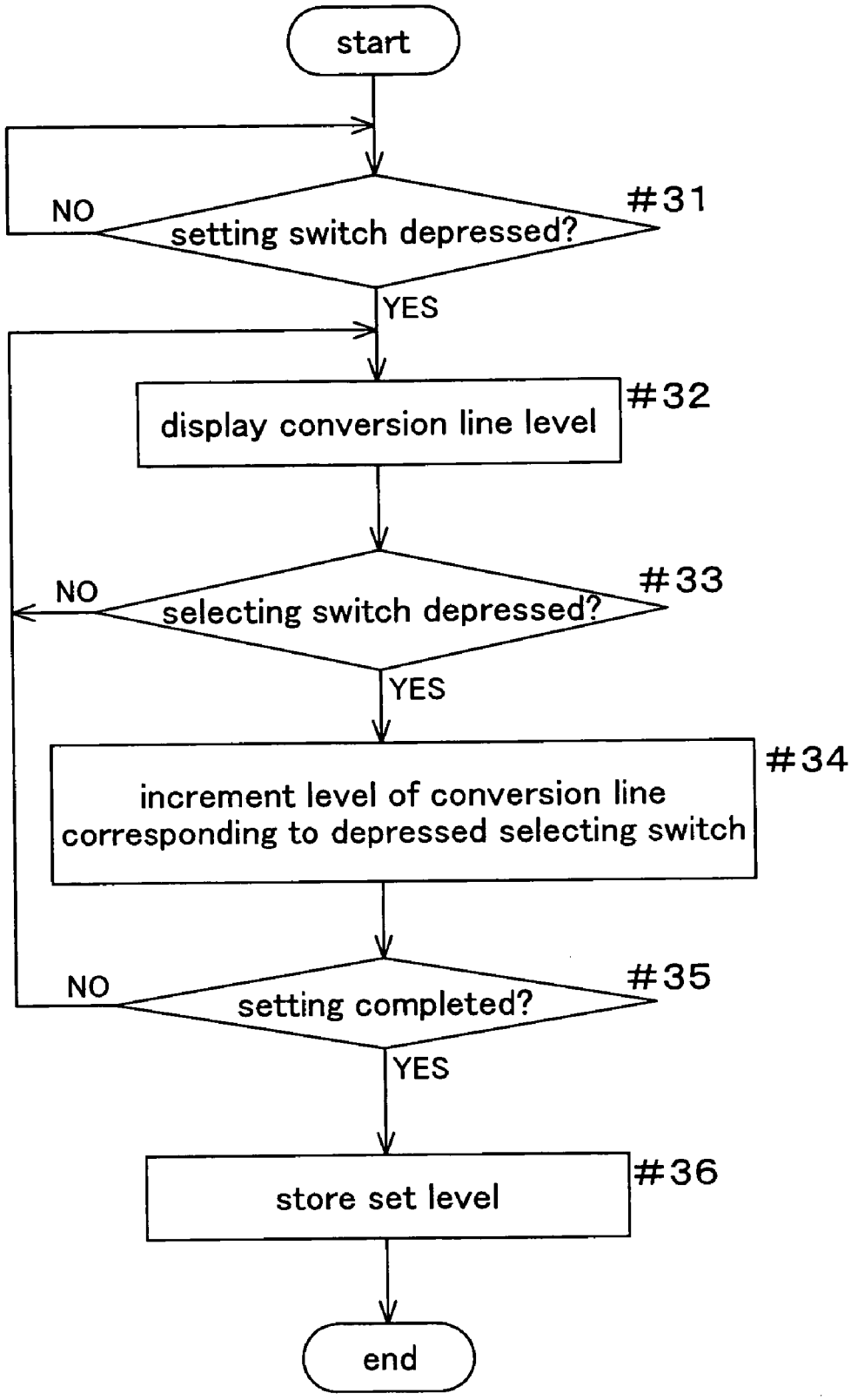
FIG. 11 is a flowchart illustrating an operation of a setting mode.

FIG. 11 shows a flowchart of the setting mode.

At step #31, the controller 28 determines whether the setting switch 31 has been depressed or not. That is, if the controller 28 receives an ON signal of the setting switch 31, the process goes to step #32. At step #32, as shown in FIG. 7 (*a*), the respective conversion lines L levels of the left side and right side pivots are displayed at the displaying section 42 of the display device 41.

At step #33, the process determines whether either the left side selecting switch 32 or the right side selecting switch 33 has been depressed or not. If either the left side selecting switch 32 or the right side selecting switch 33 has not been depressed, then, the process returns to step #32. At step #34, as shown in FIG. 7 (*b*), with each depression of the left side selecting switch 32 or the right side selecting switch 33, the level of the conversion line L in the control map corresponding to the depressed selecting switch is incremented.

At step #35, the controller 28 determines whether the setting has been completed or not. That is, the controller 28 will determine that the setting has been completed, if the setting switch 31 is depressed. After completion of the setting, the controller 28 goes on to step #36, otherwise returns to step #32.

At step #36, each level for the right or left pivot incremented at step #34 is stored at the level storing section 43.

With the setting mode, i.e. with the operation signal varying function 40, it is possible to set the electric currents to be outputted to the respective SP electromagnetic valves 35*h*, 35*i* corresponding to the operational amount, independently of each other.

Figure 12:
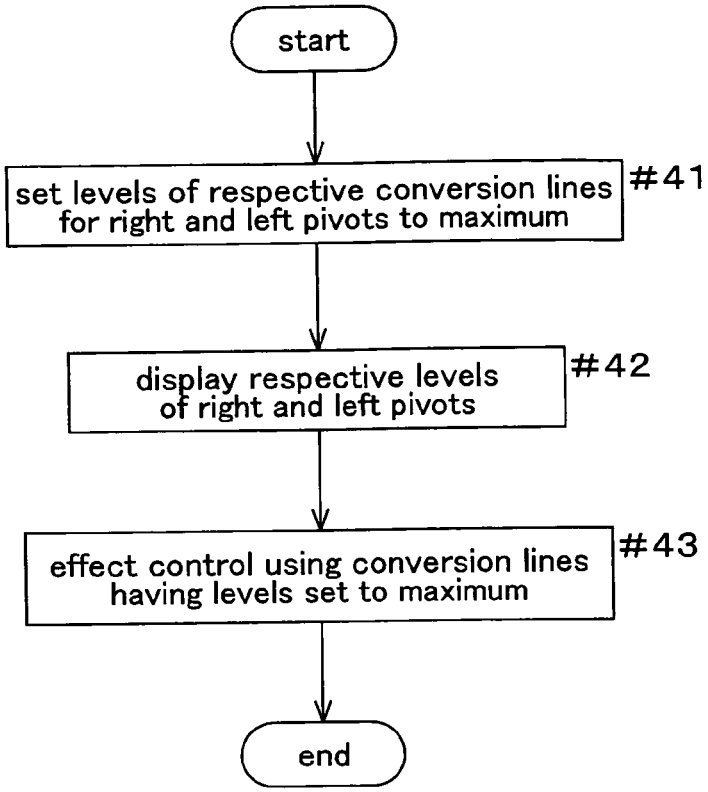
FIG. 12 is a flowchart illustrating an operation in a bidirectional full-open mode.

FIG. 12 shows a flowchart of the bidirectional full open mode.

At step #41, if the controller 28 is set to the bidirectional full open mode by the operation switch 30, the controller 28 sets the levels of the conversion lines L for the right and left pivots in the control map to the maximum. At step #42, the displaying section 42 of the display device 41 displays the mode being now set to the bidirectional full open mode and the levels of the right and left pivots of the volume switch 27 being now set to the maximum.

At step #43, the controller 28 outputs the operation signals S2 to the respective SP electromagnetic valves 35*h*, 35*i* corresponding to the operational amount of the volume switch 27, by using the conversion lines L being set to the maximum levels in the control map.

Therefore, in the bidirectional full open mode, the levels of the conversion lines L1, L2 in the control map are fixed to the maximum. Hence, the inclinations of the conversion lines L1, L2 and the output current values from the conversion lines L1, L2 are maximum. Therefore, the operation speed of the attachment when the volume switch 27 is pivoted maximally can be fastest and also the response speed in response to the operation of the volume switch 27 can be fast.

Figure 13:
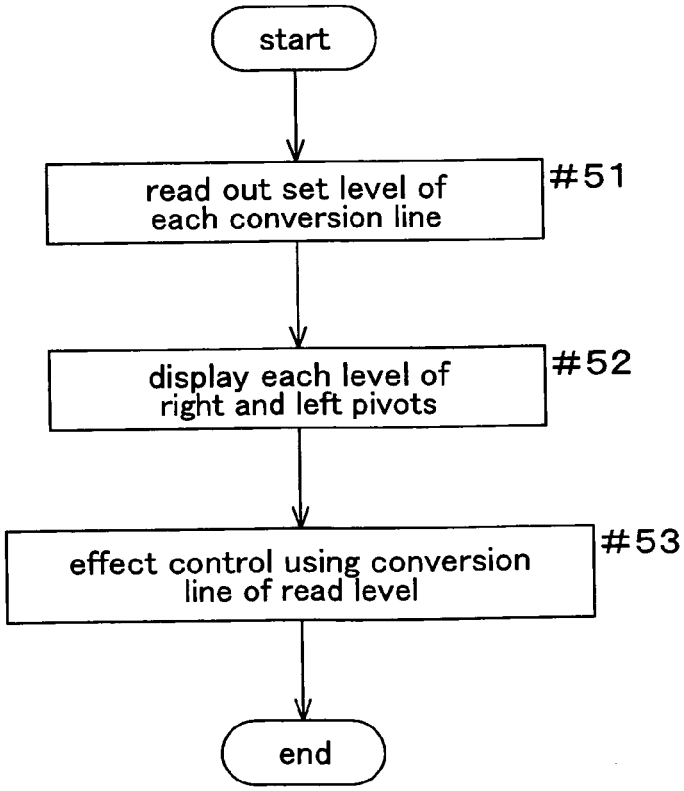
FIG. 13 is a flowchart illustrating an operation in a bidirectional speed limited mode.

FIG. 13 shows a flowchart of the bidirectional speed limited mode.

At step #51, if the controller 28 is set to the bidirectional speed limited mode by the operation switch 30, the controller 28 reads out, from the level storing section 43, the levels of the conversion lines L corresponding to both the left side pivot and the right side pivot. At step #52, the displaying section 42 of the display device 41 displays the mode being now set to the bidirectional speed limited mode and the respective levels of the conversion lines L for the right and left pivots.

At step #53, the controller 28 outputs to the respective SP electromagnetic valves 35*h*, 35*i*, the operation signals S2 corresponding to the operational amounts of the volume switch 27 by using the respective conversion liens L corresponding to the read levels.

Therefore, in this bidirectional speed limited mode, the actuator (attachment) can be operated with using the levels of the conversion lines L1, L2 set in the setting mode. Hence, the work can be carried out at an operation speed suitable for operation of each attachment. And, even for a same kind of attachment, the operation speed thereof may be increased or decreased, depending on each particular work situation encountered.

Figure 14:
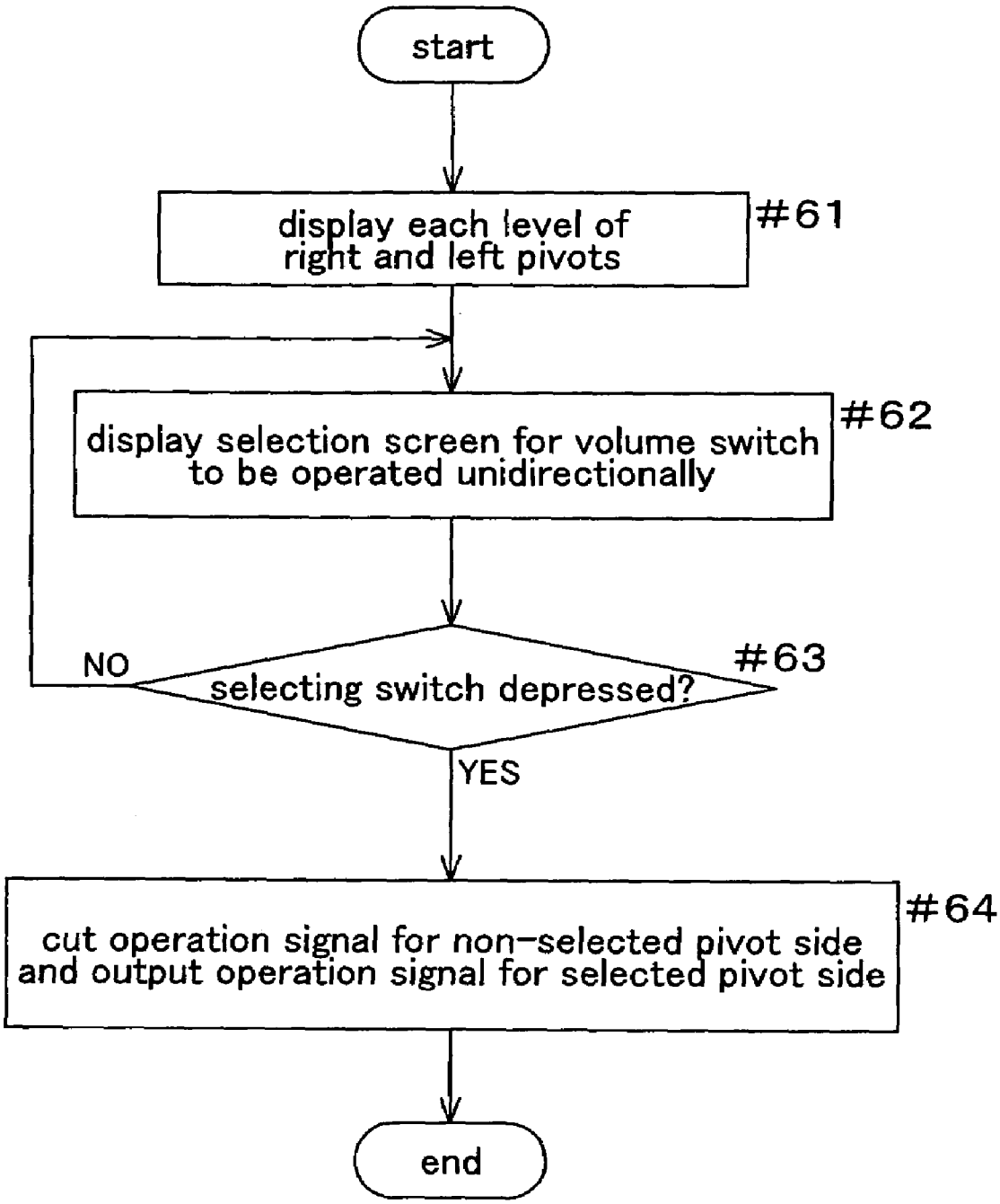
FIG. 14 is a flowchart illustrating an operation in an unidirectional speed limited mode.

FIG. 14 shows a flowchart of the unidirectional speed limited mode.

At step #61, if the controller 28 is set to the unidirectional speed limited mode by the operation switch 30, the controller 28 reads out, from the level storing section 43, the levels of the conversion lines L corresponding to both the left side pivot and the right side pivot and displays the levels for the respective pivots. At step #62, as shown in FIG. 7 (*c*), the process displays a selection screen for the volume switch 27 for the unidirectional operation.

At step #63, the process determines whether either the left side selecting switch 32 or the right side selecting switch 33 has been depressed or not. If the left side selecting switch 32 or the right side selecting switch 33 has been depressed, then, the process of the controller 28 goes on to step #64. On the other hand, if the left side selecting switch 32 or the right side selecting switch 33 has not been depressed, the process returns to step #62.

At step #64, the controller 28 reads out, from the level storing section 43, the level of the conversion line L corresponding to the side selected by the selecting switch and cuts the conversion line L corresponding to the non-selected side. For instance, as shown in FIG. 4, if the right side selecting switch 33 has been depressed, the conversion line L corresponding to the right side pivot is read out and the operation signal S2 corresponding to the operational amount of the volume switch 27 with. using this conversion line L will be outputted to the SP right side electromagnetic valve 35. In the control according to the control map, the conversion lines L in the control map for the non-selected left side will all be cut, so that even if the volume switch 27 is pivoted to the left side, the controller 28 will not output the operation signal S2 to the SP left side electromagnetic valve 35.

Therefore, in this unidirectional speed limited mode, the actuator (attachment) can be operated in one direction alone with using one of the conversion lines L1, L2 set in the setting mode. And, even for a same kind of attachment, the operation speed thereof may be increased or decreased, depending on the particular work situation encountered.

As described above, the respective modes, if e.g. the grapple 90 shown in FIG. 6 (*a*) is attached to the leading end of the arm and operated with selection of the bidirectional full speed mode. This grappled 90 can be operated speedily. On the other hand, if the level of the conversion line L is set smaller than the maximum in the setting mode and the bidirectional speed limited mode is selected, this grapple 90 can be operated under a speed limited condition, i.e. slowly. Further, if e.g. the thumb 91 shown in FIG. 6 (*b*) is attached to the leading end of the arm and operated with selection of the bidirectional full speed mode. This thumb 91 can be operated speedily. On the other hand, if the level of the conversion line L is set smaller than the maximum in the setting mode and the bidirectional speed limited mode is selected, this thumb 91 can be operated under a speed limited condition, i.e. slowly.

If e.g. the breaker 92 shown in FIG. 6 (*c*) is attached to the leading end of the arm and operated with selection of the unidirectional full speed mode. This breaker 92 can be operated. Then, if the level of the conversion line L is set to the maximum in the setting mode and the unidirectional speed limited mode is selected, this breaker 92 can be operated at the maximum speed. On the other hand, if the level of the conversion line L is set smaller than the maximum in the setting mode and the unidirectional speed limited mode is selected, this breaker 92 can be operated under a speed limited condition, i.e. slowly. If e.g. the brush cutter 93 shown in FIG. 6 (*d*) is attached to the leading end of the arm and the unidirectional speed limited mode is selected, the brush cutter 93 can be rotatably driven in one direction. Then, if the level of the conversion line L is set to the maximum in the setting mode and the unidirectional speed limited mode is selected, this brush cutter 93 can be operated at the maximum speed. On the other hand, if the level of the conversion line L is set smaller than the maximum in the setting mode and the unidirectional speed limited mode is selected, this brush cutter 93 can be operated under a speed limited condition, i.e. slowly.

As described above, with this work machine, in accordance with variety of attachments attached thereto, the speeds of these attachments can be appropriately varied for effecting an optimum work.

Figure 15:
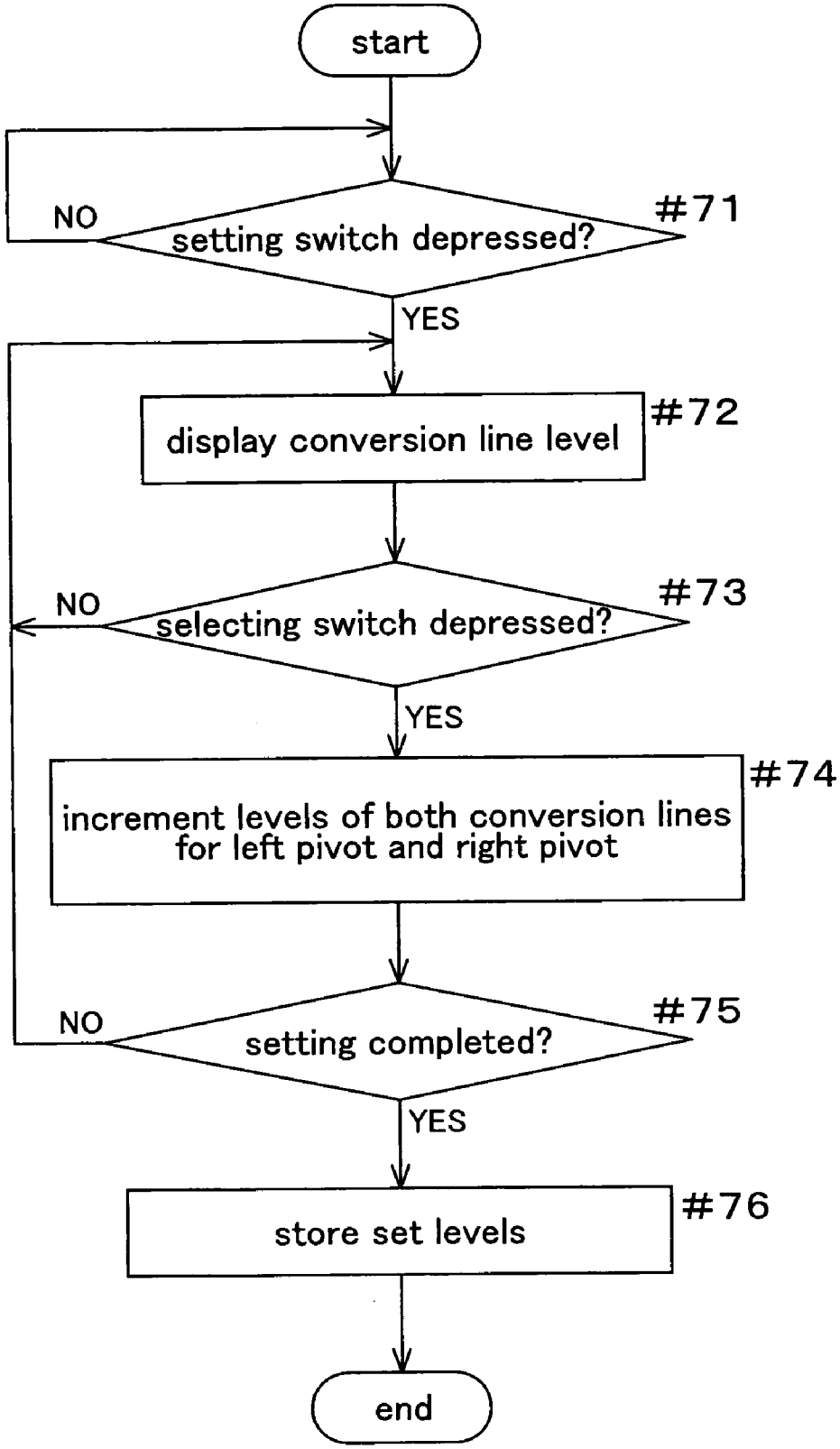
FIG. 15 is a flowchart illustrating modification in the operation of the setting mode.

FIGS. 15 and 16 show an embodiment with modification of the setting mode described above. In the case of the foregoing setting mode, the levels of the conversion lines L corresponding to the right and left pivots can be set separately from each other. Whereas, this embodiment is configured to allow simultaneous level setting (setting to a same level) of the conversion lines L for the right and left pivots. In this case, as the levels of the conversion lines L for the right and left pivots are set to a single same value, the two selecting switches should be replaced by a single level incrementing switch.

At step #71, the controller 28 determines whether the setting switch 31 has been depressed or not. That is, if the controller 28 receives an ON signal from the setting switch 31, at step #72, as shown in FIG. 16 (*a*), the level of the conversion line L is displayed at the displaying section 42 of the display device 41.

At step #73, the process again determines whether the level incrementing switch has been depressed or not. If the setting switch 31 has not been depressed, the process returns to step #72. At step #74, as shown in FIG. 16 (*b*), the level is incremented in response to each depression of the level incrementing switch.

At step #75, the process determines whether the setting has been completed or not. That is, the controller 28 determines that the setting has been completed if the setting switch 31 is depressed. Upon completion of the setting, the process of the controller 28 goes on to step #76. Otherwise, the process returns to step #72. At step #74, the level incremented at step #74 is stored at the level storing section 43.

Therefore, the levels of the conversion lines L in the control map of the controller 28 are set to a same level for both the right and left pivots. Hence, in effecting the control in the operation mode, the control will be effected for the right and left pivots based on the same level of conversion lines L.

As described above, this work machine 1 includes an attachment operable by an actuator, the control valve 24 for feeding working oil to the actuator for operating the attachment, the electromagnetic valve 35 operable in response to the operation signal S2 for adjusting the pilot pressure to the control valve 24, and the controller 28 operable to output to the electromagnetic valve 24 the operation signal S2 corresponding to the operational amount of the operational member 25 (volume switch 27) and the controller 28 has the operation signal varying function 40 for varying the operation signal S2 corresponding to the operational amount of the operational member 25. Therefore, by varying the operation signal S2, the speed of the attachment can be varied, depending on the kind of the attachment. That is, as the operation signal varying function 40 allows variation in the operation speed and the response speed of the actuator for an operational amount of the volume switch 27, the operation of the attachment is significantly facilitated.

As the operation signal varying function 40 allows multiple stage variation in the change mount of the operation signal S2 corresponding to the operational amount of the volume switch 27, the response speed of the actuator for the operational amount can be varied as desired. That is, the possibility of multiple stage variation in the change amount of the operation signal S2 allows the attachment to be operated quickly or slowly as desired.

In the controller 24, in order to allow the bidirectional operation of the actuator, the two electromagnetic valves 35*h*, 35*i* are connected to the single control valve 24*e*. Further, the controller 28 includes the operation signal cutting function 44 for cutting the operation signal S2 to be outputted to one electromagnetic valve so that the actuator may be operated in one direction alone, Therefore, with such very simple construction, the actuator can be selectively operated in both directions or one direction alone.

The operation signal varying function 40 is constructed to allow multiple stage setting in the change amounts of the operation signals S2 to the two electromagnetic valves (both electromagnetic valves) 35*h*, 35*i* independently of each other. Hence, the response speed of the actuator for an operational amount of the volume switch 27 pivoted to the left side or the right side can be freely varied.

Moreover, by setting the non-effective mode in case the volume switch 27 is not operated, even if the volume switch 27 is moved inadvertently when the operator is gripping and operating the operational lever, the attachment associated with the volume switch will not be moved. Hence, the operation of the operational lever can be effected easily.

Also, when the operation of the volume switch 27 is completed e.g. when the engine 7 is stopped, the controller 28 stores the presently set operation mode at the mode storing section 46 and switches over from the effective mode to the non-effective mode. Therefore, when the non-effective mode is switched over to the effective mode again, the actuator can be operated with the operation mode stored at the mode storing section 46. Hence, there is no need of setting an operation mode for each operation. Hence, the operation can be effected easily.

Further, the controller 28 of the work machine has the effective mode for allowing the actuator to be operated according to an operation of the volume switch 27 when the power source such as the engine 7 for activating the actuator is operable and the non-effective mode for inhibiting the actuator from being operated even if the volume switch 27 is operated and the controller 28 further includes the mode confirming means for switching over from the non-effective mode to the effective mode when the controller 28 is set to the non-effective mode. Therefore, when the engine 7 is started and the attachment is to be operated by the volume switch 27, the attachment will not be moved unless the mode is switched over from the non-effective mode to the effective mode.

Therefore, when operating the attachment, the operator will e.g. first confirm the switchover from the non-effective mode to the effective mode with depression of the operation switch 30. As the operator can confirm the operation of he operation switch 30, the operation can be carried out in a safer manner.

Moreover, by setting the non-effective mode in case the volume switch 27 is not operated, even if the volume switch 27 is moved inadvertently when the operator is gripping and operating the operational lever, the attachment associated with the volume switch will not be moved. Hence, the operation of the operational lever can be effected easily.

Also, when the operation of the volume switch 27 is completed e.g. when the engine 7 is stopped, the controller 28 stores the presently set operation mode at the mode storing section 46 and switches over from the effective mode to the non-effective mode. Therefore, when the non-effective mode is switched over to the effective mode again, the actuator can be operated with the operation mode stored at the mode storing section 46. Hence, there is no need of setting an operation mode for each operation. Hence, the operation can be effected easily.

Other Embodiments

The work machine of the invention is not limited to the machine described in the foregoing embodiment. Namely, in the foregoing embodiment, the controller 28 includes the control map for controlling the SP electromagnetic valves 35*h*, 35*i*. However, the control map having the plurality of conversion lines L is not limited to that for controlling the SP electromagnetic valves 35*h*, 35*i*, but can be a control map for controlling the electromagnetic valves 35 for varying the pilot pressures to the respective control valves 24 for the arm 19, the bucket 20, the swivel deck 12, etc. With such alternative construction, it becomes possible not only to control e.g. the speeds of various attachments such as the grapple 90, the thumb 91, the breaker 92, the brush cutter 93, the tilt bucket, but also to control the speed of the arm 19, the bucket 20, the swivel deck 12, etc. by varying the levels of the conversion lines L.

Further, in the foregoing embodiment, the effective mode and the non-effective mode are set in the controller 28 for rendering effective or non-effective the control of the volume switch 27. However, the control by the effective mode and the non-effective mode is not limited to the control of the volume switch 27, but can be control of the left and right operational levers 26L, 26R. Namely, in this case, the non-effective mode will inhibit the actuator operation even if the left or right operational lever 26L, 26R is operated and the effective mode will allow the actuator to be operated according to an operation of the left or right operational lever 26L, 26R.

In the foregoing embodiment, the OFF operation of the key switch 34 of the engine 7 is determined as the completion of setting of the operational member 25 (volume switch 27) and then the mode is switched over form the effective mode to the non-effective mode. Instead, a locking operation of the operational member 25 by a lever locking device for locking and rendering the operational member 25 inoperative may be determined as the completion of setting. More particularly, as shown in FIG. 19, with the lever locking device provided in the work machine, when a locking lever 86 disposed adjacent the operational member 25 is pivoted upward (condition denoted with "a" in FIG. 18), an unillustrated unload valve unloads the first oil passage 38*a* or the second oil passage 38*b*, thus inhibiting feeding of the working oil to the respective control valve 24. Whereas, when the locking lever 86 is pivoted downward (condition denoted with "b" in FIG. 18), the unload. valve loads the first oil passage 38*a* or the second oil passage 38*b*, thus allowing feeding of the working oil to the respective control valve 24. And, in association with the upward pivotal operation of the locking lever 86, the mode is switched over from the effective mode to the non-effective mode.

Further, in the foregoing embodiment, the various attachments each attached to the leading end of the arm 19 are operated by the volume switch 27 provided at the head portion of the right operational lever 26R. Instead, the attachments can be adapted to be operated by a pedal 50 disposed at the left fore side of the driver's seat 9, the pedal 50 being pivotable in the fore and aft direction. In this case, needless to say, the control map should be modified such that the conversion lines L will be distributed about the origin O, not for the right and left pivots, but for the fore and aft pivots.

The invention claimed is:

1. A work machine comprising:

an attachment movable by an actuator;

an operational member for operating the attachment through the actuator; and a controller operable to output an operation signal for operating the actuator in response to an operation of the operational member;

wherein the controller allows setting of a change amount in the operation signal corresponding to an operational amount of the operational member, independently for each operational direction of the actuator, and wherein the change amount corresponds to a conversion rate of the operational amount of the operational member into an electric current value transmitted by the controller.

2. The work machine according to claim 1, wherein said controller allows the change amount in the operation signal corresponding to the operational amount of the operational member to be set in multiple steps.

3. The work machine according to claim 1, wherein said actuator is operable by working oil;

said work machine further comprises a control valve for feeding the working oil to the actuator and a plurality of electromagnetic valve connected to said control valve and provided in correspondence with a plurality of operational directions of said actuator;

said each electromagnetic valve is operable in response to said operation signal to adjust a pilot pressure for said control valve, thus adjusting an opening degree of said control valve; and said controller allows the setting of the change amount in the operation signal corresponding to the operational amount of the operational member, independently for each of the plurality of electromagnetic valves.

4. The work machine according to claim 3, wherein said electromagnetic valves comprise two electromagnetic valves connected to said control valve so that said actuator is movable in two directions opposite to each other.

5. The work machine according to claim 1, wherein said controller includes an effective mode for allowing said actuator to be operated according to an operation of the operational member and a non-effective mode for inhibiting said actuator from being operated in response to the operation of the operational member.

6. The work machine according to claim 5, wherein said effective mode of the controller includes a plurality of operation modes for providing various operation modes of the actuator.

* * * * *